US005784677A

United States Patent [19]

Tamura et al.

[11] Patent Number: 5,784,677

[45] Date of Patent: *Jul. 21, 1998

[54] ELECTROPHOTOGRAPHIC PRINTER AND PRINTING METHOD USING SPECIFIC INTERMEDIATE TRANSFER DRUM AND TRANSFER ROLLER ARRANGEMENT

[75] Inventors: Yoshihiro Tamura, Tokyo; Hidetoshi Hara; Yuichi Nakao, both of Otsu; Kazuo Ishiwari, Ichikawa, all of Japan

[73] Assignee: Toray Industries Inc., Tokyo, Japan

[ * ] Notice: The term of this patent shall not extend beyond the expiration date of Pat. No. 5,394,232.

[21] Appl. No.: 656,527

[22] Filed: May 31, 1996

Related U.S. Application Data

[62] Division of Ser. No. 305,921, Sep. 16, 1994, abandoned, which is a division of Ser. No. 35,273, Mar. 22, 1993, Pat. No. 5,394,232.

[30] Foreign Application Priority Data

Mar. 25, 1992 [JP] Japan ..... 4-066719

[51] Int. Cl.[6] ..... G03G 15/01

[52] U.S. Cl. ..... 399/302

[58] Field of Search ..... 355/256, 258, 355/257, 277, 279, 326 R, 327; 118/645, 647, 651, 659; 399/302, 307, 308, 226, 228

[56] References Cited

U.S. PATENT DOCUMENTS

| | | | |
|---|---|---|---|
| 3,876,282 | 4/1975 | Schon et al. . | |
| 3,893,761 | 7/1975 | Buchan et al. . | |
| 3,955,530 | 5/1976 | Knechtel . | |
| 3,970,383 | 7/1976 | Honda et al. . | |
| 4,325,627 | 4/1982 | Swidler et al. . | |
| 4,634,252 | 1/1987 | Jeremijevic . | |
| 4,663,257 | 5/1987 | Murasawa et al. . | |
| 4,690,539 | 9/1987 | Radulski et al. . | |
| 4,708,460 | 11/1987 | Langdon . | |
| 4,752,138 | 6/1988 | Rufer . | |
| 4,910,558 | 3/1990 | Giezeman et al. . | |
| 4,935,788 | 6/1990 | Fanetuzzo et al. . | |
| 4,990,962 | 2/1991 | Kishi . | |
| 5,040,028 | 8/1991 | Kamimura et al. | 399/302 |
| 5,047,808 | 9/1991 | Landa et al. . | |
| 5,150,161 | 9/1992 | Bujese . | |
| 5,153,659 | 10/1992 | Maiefski et al. . | |
| 5,394,232 | 2/1995 | Tamara et al. | 355/327 |

FOREIGN PATENT DOCUMENTS

| | | |
|---|---|---|
| 0318078 | 5/1989 | European Pat. Off. . |
| 62-134673 | 6/1987 | Japan . |
| 0123383 | 5/1990 | Japan . |
| 0132682 | 6/1991 | Japan . |
| 8685 | 1/1996 | Japan . |

*Primary Examiner*—Robert Beatty

[57] ABSTRACT

An electrophotographic printer includes: a photosensitive drum; a latent image forming portion for forming electrostatic latent images on the photosensitive drum based on print information; a developing portion for developing the electrostatic latent images using toner; an intermediate transfer drum for receiving the toner images from the photosensitive drum; a transportation portion for delivering a recording medium; and a transfer roll for transferring the toner image from the intermediate transfer roll to the recording medium. A pressure force $P_1$ between the photosensitive drum and the intermediate transfer drum is less than a pressure force $P_2$ between the transfer roll and the intermediate transfer drum. $P_1$ and $P_2$ may also have the relationship $P_1 \geqq P_2 \sin\theta$, where $\theta$ is an angle formed between a line through the centers of rotation of the intermediate transfer drum and the transfer roll, and a line perpendicular to a line through the centers of rotation of the photosensitive drum and the intermediate transfer drum. The transfer roll may be separated from the intermediate transfer drum when the image is transferred from the photosensitive drum to the intermediate transfer drum.

26 Claims, 17 Drawing Sheets

26

ELECTROPHOTOGRAPHIC PRINTER AND PRINTING METHOD USING SPECIFIC INTERMEDIATE TRANSFER DRUM AND TRANSFER ROLLER ARRANGEMENT

This application is a divisional of application Ser. No. 08/305,921, filed on Sep. 16, 1994, now abandoned the entire contents of which are hereby incorporated by reference, which was a divisional of application Ser. No. 08/035,273, filed on Mar. 22, 1993 now U.S. Pat. No. 5,394,232.

BACKGROUND OF THE INVENTION

1. Field of the Invention

The present invention relates to an electrophotographic printer and an electrophotographic printing method, and more particularly, to an electrophotographic printer, provided with an intermediate transfer drum, and an electrophotographic printing method.

2. Description of the Related Art

Electrophotographic apparatuses, e.g., electrophotographic printers, are designed so that electrostatic latent images formed on a photosensitive medium are developed by means of toners, and the resulting toner images are heated under pressure and fixed on a recording medium, such as paper, by using a heating roll or other transfer means.

Some of these electrophotographic apparatuses are provided with intermediate transfer means, such as a belt or drum, which can transfer the toner images to various recording media, including paper, plastic films, metal sheets, etc.

The conventional electrophotographic apparatuses furnished with the intermediate transfer means include, for example, a transfer-fixing device described in Unexamined Japanese Patent Publication (KOKAI) No. 50-23234 (U.S. Pat. No. 3,955,530) and an electrophotographic toner transfer and fusing apparatus described in Examined Japanese Patent Publication (KOKOKU) No. 57-20632 (U.S. Pat. No. 3,893,761). The former is a wet type which uses liquid toners, while the latter is a dry type which uses dry toners. In the latter type, moreover, a belt is used as the intermediate transfer means. An electrophotographic printing machine described in Unexamined Japanese Patent Publication (KOKAI) No. 63-34573 (U.S. Pat. No. 4,708,460) is known as an example of the wet type which uses a belt as the intermediate transfer means.

The wet electrophotographic apparatuses of the liquid-toner type, which can use minute toner particles of submicron order, have an advantage over the dry type in being able to produce sharper images of higher resolution.

In making a color print by using one such electrophotographic apparatus, an electrostatic latent image corresponding to one color, e.g., magenta, is formed on the photosensitive medium, and is developed by means of a magenta liquid toner. Then, the resulting toner image is transferred to the intermediate transfer means, e.g., an intermediate transfer drum, which is pressed against the photosensitive medium. Thereafter, cyan and yellow toner images are successively transferred, in layers, to the intermediate transfer drum in like manner. Subsequently, transfer-fixing means, such as a heating roll, is pressed against the intermediate transfer drum, whereby the toner image on the transfer drum is transferred to and fixed on paper or some other recording medium, thus forming the color print.

Thus, according to this conventional electrophotographic printer or electrophotographic printing method, the color print is produced by transferring to and fixing the toner image on the recording medium by means of the intermediate transfer drum. To shorten the time for the production of the color print, in this case, the transfer of a toner image for the last color to the intermediate transfer drum is preferably effected by concurrent processing such that the heating roll is pressed against the transfer drum to fix the toner image on the recording medium while the toner image for the last color is being transferred.

When the heating roll is pressed against the intermediate transfer drum, the transfer drum is subjected to a stress such that the force of pressure between the photosensitive medium and the transfer drum is disturbed, depending on the direction in which the heating roll is pressed. Thus, the force of pressure between the intermediate transfer drum and the photosensitive medium varies, so that the toner images transferred to the intermediate transfer drum are battered and become unclear.

According to the electrophotographic printer or electrophotographic printing method of the wet-developing type, liquid toners of different colors are mixed and soiled by one another, so that the resulting color print is liable to be lowered in quality, e.g., in clearness. If the soiling between the liquid toners is prevented by modifying the construction, the electrophotographic printer will inevitably be complicated in structure and large-sized, thus failing to comply with users' request.

SUMMARY OF THE INVENTION

An object of the present invention is to provide an electrophotographic printer and an electrophotographic printing method, in which the force of pressure between a photosensitive medium and intermediate transfer means is not influenced by contact between the intermediate transfer means and a transfer-fixing means under pressure.

Another object of the present invention is to provide an electrophotographic printer and an electrophotographic printing method, in which liquid toners are prevented from soiling one another so that high-quality color prints can be produced.

In order to achieve the above objects, according to the present invention, there is provided an electrophotographic printer for forming a color print based on print information on a recording medium, which comprises: a photosensitive drum; latent image forming means for forming electrostatic latent images based on the color-separated print information for individual colors on the photosensitive drum; wet developing means having a developing function to develop the electrostatic latent images successively into toner images for the individual colors by means of liquid toners of different colors corresponding to the print information and a squeeze function to squeeze surplus liquid toners on the photosensitive drum; an intermediate transfer drum pressed against the photosensitive drum so that the toner images of the individual colors developed on the photosensitive drum are successively transferred to and deposited in layers on the intermediate transfer drum to form a multicolor toner image thereon; transportation means for delivering the recording medium, to which the multicolor toner image is to be transferred, to and from the intermediate transfer drum; and transfer-fixing means for transferring to and fixing the multicolor toner image, transferred to the intermediate transfer drum, on the recording medium, thereby forming the color print.

Preferably, the wet developing means includes a plurality of developing units for developing the electrostatic latent images for the individual colors by means of the liquid toners of the different colors corresponding to the print information.

Further preferably, each of the developing units is provided with a developing roller and a squeeze roller urged toward the photosensitive drum.

Preferably, the developing units are removably fitted with toner cartridges containing the liquid toners of the different colors, individually.

Further preferably, the toner cartridge includes a main tank containing a developing liquid toner and an auxiliary tank containing a toner for replenishment to be supplied to the main tank.

Further preferably, the toner cartridge includes at least one magnetic rotor in the main tank for stirring the liquid toner, the magnetic rotor being rotated by means of rotating means in an outside position corresponding thereto.

Preferably, the wet developing means includes drive means for moving the developing units in a direction tangent to the photosensitive drum.

Preferably, the transfer-fixing means includes a heating roll having a heater therein for heating the multicolor toner image under pressure, thereby transferring to and fixing the multicolor toner image on the recording medium.

Further preferably, the transfer-fixing means includes a push mechanism for releasably pressing the heating roll against the intermediate transfer drum with a predetermined force of pressure.

Preferably, the transfer-fixing means includes a center of rotation, and is arranged so that the transfer-fixing means is arranged so that a line which connects the respective centers of rotation of the intermediate transfer drum and the transfer-fixing means is within an angular range from −30° to 30° with respect to a direction perpendicular to a line which connects the respective centers of rotation of the photosensitive drum and the intermediate transfer drum when the transfer-fixing means is pressed against the intermediate transfer drum, the lines and the perpendicular direction being on the same plane.

Further preferably, the angle between the line which connects the respective centers of rotation of the intermediate transfer drum and the transfer-fixing means, and the direction perpendicular to the line which connects the respective centers of rotation of the photosensitive drum and the intermediate transfer drum is substantially zero.

According to the present invention, moreover, there is provided an electrophotographic printing method which includes forming electrostatic latent images on a photosensitive medium in accordance with print information, developing the electrostatic latent images while applying a developing bias voltage thereto, and transferring to and fixing developed toner images on the recording medium, thereby forming a color print, the method comprising: a latent image forming process for forming the electrostatic latent images based on the color-separated print information for individual colors on the photosensitive medium; a wet developing process for developing the electrostatic latent images on the photosensitive medium successively into toner images for the individual colors by means of liquid toners of different colors corresponding to the print information and squeezing surplus liquid toners on the photosensitive medium; an intermediate transfer process for successively transferring to and depositing in layers the toner images of the individual colors, developed on the photosensitive medium, on an intermediate transfer medium to form a multicolor toner image thereon; and a transfer-fixing process for transferring to and fixing the multicolor toner image, formed in the intermediate transfer process, on the recording medium, thereby forming the color print.

Preferably, the latent image forming process includes forming the electrostatic latent images based on the print information for yellow, magenta, cyan, and black colors in the order named on the photosensitive medium.

Preferably, the wet developing process increasing the developing bias voltage in changing the developing units for developing the electrostatic latent images on the photosensitive medium.

Preferably, the transfer-fixing process is started when the transfer of the last toner image to the intermediate transfer medium is started in the intermediate transfer process.

According to the electrophotographic printer and the electrophotographic printing method of the present invention, great effects can be obtained such that the toner images transferred from the photosensitive drum to the intermediate transfer means are subject to no disturbance, the liquid toners are soiled less by one another, and a sharp color print with high resolution can be produced.

The above and other objects, features, and advantages of the invention will be more apparent from the ensuing detailed description taken in connection with the accompanying drawings.

DETAILED DESCRIPTION OF THE PREFERRED EMBODIMENTS

An electrophotographic printer and an electrophotographic printing method according to one embodiment of the present invention will now be described in detail with reference to the accompanying drawings.

Figure 1:
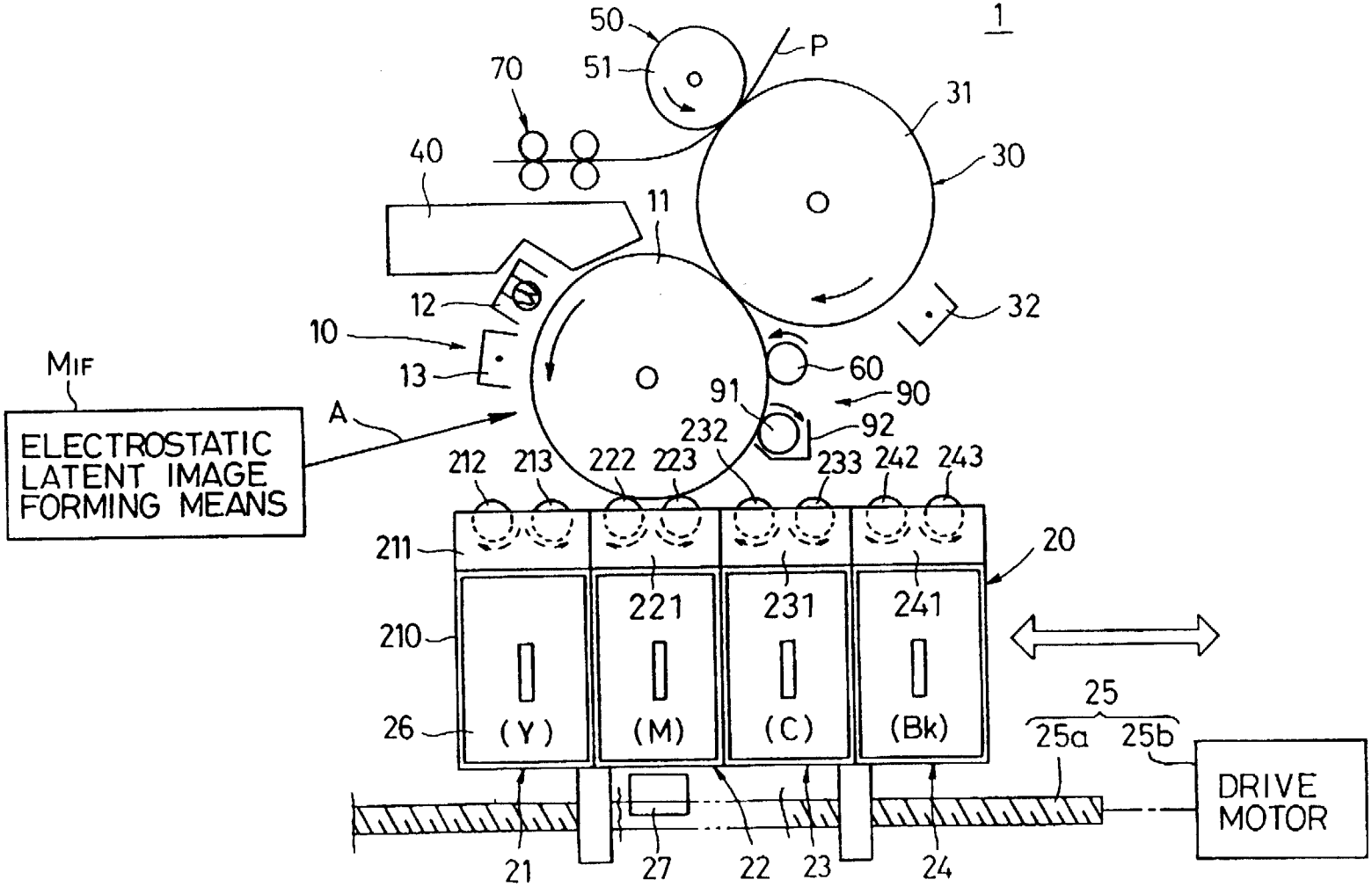
FIG. 1 is a general view showing one embodiment of an electrophotographic printer to which an electrophotographic printing method according to the present invention is applied.

Referring first to FIG. 1, an outline of the electrophotographic printer, to which the electrophotographic printing method according to the present invention is applied, will be described. The electrophotographic printer 1 comprises photosensitive means 10, developing means 20, intermediate transfer means 30, cleaning means 40, transfer-fixing means 50, auxiliary squeeze roller 60, paper feeder unit 70, applicator means 90, latent image forming means $M_{IF}$ for applying light for exposure in the direction of arrow A, and the like. The other arrows in FIG. 1 indicate the respective rotating directions of the individual members.

FIG. 1 is a front view of the electrophotographic printer 1. In the description to follow, the side shown in FIG. 1 will be referred to as the front side, and the side corresponding to the reverse side of the drawing as the rear side.

The photosensitive means 10 includes a photosensitive drum 11, a discharger 12 for removing residual electric charge from the drum 11, and a charger 13 for uniformly charging the drum 11. Before removing the residual electric charge, the surface of the drum 11 is cleaned by means of the cleaning means 40. The cleaning means 40, discharger 12, and charger 13 are arranged between the intermediate transfer means 30 and the developing means 20, in the order named along the rotating direction of the photosensitive drum 11.

In the photosensitive drum 11, a photosensitive medium layer of an organic photoconductor (OPC) is formed on the surface of a cylindrical drum. Besides the OPC, a selenium (Se)-based material, amorphous silicon (α-Si), etc. may be used as the material of the photosensitive medium layer, for example. The discharger 12, which may be an LED array or a miniature incandescent light bulb, applies light to the surface of the drum 11, thereby erasing the residual latent image. The charger 13 uniformly charges the photosensitive drum 11 with ions produced by corona discharge.

The latent image forming means $M_{IF}$, which is used to form electrostatic latent images on the surface of the photosensitive drum 11, includes a laser source, liquid crystal shutter, etc. The image forming means $M_{IF}$ applies a laser beam to the surface of the drum 11 in the direction of arrow A in accordance with print information corresponding to each color of a color document, thereby forming the electrostatic latent images corresponding to the print information on the drum surface. An LED array may be used as exposure means for applying the print information to the surface of the photosensitive drum 11.

The developing means 20 includes first to fourth developing units 21 to 24, drive means 25 for moving the developing units 21 to 24 in a body in the horizontal direction of FIG. 1, and toner cartridges 26 provided individually for the units 21 to 24 and removably set in a housing 210. The drive means 25 includes a ball screw 25*a* and a drive motor 25*b*. The first developing unit 21 is formed with a liquid tank 211 for liquid toner at the upper portion of the housing 210. Housed in the lower portion of the unit 21 is a toner cartridge 26 which contains a liquid toner of one color. A developing roller 212 and a squeeze roller 213 are arranged at a predetermined distance from each other in the liquid tank 211, extending in parallel relation.

In the developing means 20, the developing units 21 to 24 have their respective toner cartridges 26 individually containing liquid toners of yellow (Y), magenta (M), cyan (C), and black (Bk). In a predetermined position before the start of developing operation, the developing means 20 is located on the right of the photosensitive drum 11 in FIG. 1. In performing the developing operation, the developing units 21, 22, 23 and 24 are successively moved toward the photosensitive means 10 in the order named, by means of the drive means 25, and the electrostatic latent images formed corresponding to the individual colors are developed in succession. Each liquid toner used is formed of toner particles of yellow, magenta, cyan, etc. dispersed in a liquid carrier.

The developing units, which will be described in detail later, are constructed in the same manner. In the description to follow, therefore, like or corresponding reference numerals are used to designate like or corresponding portions of the individual developing units throughout the drawings for simplicity of illustration.

The intermediate transfer means 30 includes an intermediate transfer drum 31 and a charger 32 disposed beside the drum 31. The toner images successively developed by means of the developing means 20 are successively transferred in layers to the surface of the intermediate transfer drum 31.

The intermediate transfer drum 31, which is formed of a cylindrical metallic drum and a thin silicone resin layer thereon, is pressed against the photosensitive drum 11. As the toner images of the individual colors are developed by the developing means 20, they are successively transferred in layers. The drum 31 may have various suitable diameters, depending the size of the recording medium used. In the present embodiment, the intermediate transfer drum 31 has the same diameter as the photosensitive drum 11. If the recording medium is large-sized, however, the diameter of the drum 31 should be greater than that of the drum 11.

The charger 32 charges the intermediate transfer drum 31 on the basis of the same principle for the charger 13 of the photosensitive means 10, and cancels the influence of the previous toner image, thereby facilitating the transfer of the next toner image of a different color from the photosensitive drum 11. Also, the charger 32 prevents the toner images already transferred to the intermediate transfer drum 31 from returning to the surface of the photosensitive drum 11.

In the intermediate transfer means 30, the toner images developed on the photosensitive drum 11 are charged by means of the charger 32 as they are successively transferred in layers to the intermediate transfer drum 31. In this process, some toner images and liquid toners remain on the photosensitive drum 11 without having been transferred to the intermediate transfer drum 31. These residues are removed by the cleaning means 40.

The cleaning means 40 includes a nonwoven fabric and a cleaning blade which are arranged in a cartridge. When the cleaning means 40 is set in the electrophotographic printer 1, the cleaning blade abuts against the photosensitive drum 11. The cleaning means 40 cleans the drum 11 in a manner such that the residual toner images and liquid toners left on the drum 11 after the image transfer to the intermediate transfer drum 31 are scraped up by means of the cleaning blade, and are wiped out by means of the nonwoven fabric. The construction of the cleaning means 40 will be described in detail later.

The transfer-fixing means 50 includes a heating roll 51, having a heater (not shown) therein, and a push mechanism (mentioned later). The heating roll 51, which is pressed against the intermediate transfer drum 31 by the push mechanism, heats and pressurizes a multicolor toner image transferred to the intermediate transfer drum 31, and transfers to and fixes the image on recording paper P.

In transferring the toner images from the photosensitive drum 11 to the intermediate transfer drum 31, the push mechanism keeps the heating roll 51 apart from the drum 31. Before that portion of the drum 31 to which the last toner image, among the four different-colored toner images, has been transferred is reached, the push mechanism presses the heating roll 51 against the intermediate transfer drum 31 with a predetermined force of pressure. Thereupon, the heating roll 51 heats and pressurizes the multicolor toner image transferred to the intermediate transfer drum 31, and transfers to and fixes the image on the recording paper P fed from the paper feeder unit 70.

The auxiliary squeeze roller 60 is disposed between the developing means 20 and the intermediate transfer means 30 with a space of, e.g., 30 μm secured between the roller 60 and the photosensitive drum 11. The roller 60 serves to remove surplus liquid toners overflowing the space, especially the liquid carrier, from the surface of the photosensitive drum 11 on which the toner images are developed. A squeeze corona charger may be used in place of the auxiliary squeeze roller 60 with the same effect.

The paper feeder unit 70 supplies the recording paper P to the space between the intermediate transfer drum 31 and the heating roll 51 when the laminated toner images on the drum 31 is fixed.

The applicator means 90, which is disposed between the developing means 20 and the auxiliary squeeze roller 60 so as to be in contact with the photosensitive drum 11, includes an applicator roller 91 and a tank 92 containing an auxiliary liquid and horizontally supporting the roller 91. The applicator roller 91, which is in contact with the photosensitive drum 11, rotates in the direction indicated by the arrow of FIG. 1, thereby applying the auxiliary liquid from the tank 92, e.g., the liquid carrier for the liquid toners, to the drum 11.

The electrophotographic printer 1 of the present invention, constructed in this manner, makes a color print by the following electrophotographic printing method.

First, the residual electric charge is removed, by means of the discharger 12, from the surface of the photosensitive drum 11, which has been cleaned by means of the cleaning means 40, and the drum surface is uniformly charged by means of the charger 13.

Then, the laser beam from the latent image forming means $M_{IF}$ is applied to the photosensitive drum 11, as indicated by arrow A in FIG. 1, so that the electrostatic latent images corresponding to the print information are successively formed on the surface of the drum 11. These laser-beam-originated latent images are formed four times in total, corresponding to the colors including yellow, magenta, cyan, and black.

Subsequently, the ball screw **25*a* is rotated by means of the drive motor 25*b*, and the developing means 20, which has so far been located on the right of the photosensitive drum 11 as in FIG. 1, is moved horizontally. Thereupon, yellow, magenta, cyan, and black toner images are successively developed by means of the first, second, third, and fourth developing units 21, 22, 23 and 24, respectively. The toner images, thus developed by means of their corresponding developing units 21 to 24, are transferred in succession to the intermediate transfer drum 31. As a result, a four-color toner image is formed on the drum 31**.

As the toner image developed by means of the fourth developing unit 24 is transferred to the intermediate transfer drum 31, the push mechanism presses the heating roll 51 against the drum 31. As a result, the four-color toner image on the transfer drum 31 is heated under pressure and fixed on the recording paper P, whereupon one process for forming the color print is finished.

In forming this color print, the auxiliary squeeze roller 60, which is disposed between the developing means 20 and the intermediate transfer drum 31 and is held against the photosensitive drum 11 with a narrow gap kept between them, removes the surplus liquid toners overflowing the gap, especially the liquid carrier, from the surface of the drum 11. Moreover, the applicator means 90 applies the auxiliary liquid from the tank 92 to the drum 11 by utilizing the rotation of the applicator roller 91. Thus, variation of the liquid carrier volume, especially the absence of the liquid carrier, which may otherwise be caused on the photosensitive drum 11 when the developing units are changed, can be prevented.

Consequently, air is prevented from getting into the gap between the photosensitive drum 11 and the auxiliary squeeze roller 60, so that the squeezing performance against the surplus liquid carrier on the surface of the drum 11 is stabilized. The developed toner images on the photosensitive drum 11 are transferred to the intermediate transfer drum 31 with a liquid carrier layer of a predetermined thickness formed uniformly.

Thus, when the toner images are transferred from the photosensitive drum 11 to the intermediate transfer drum 31, the liquid carrier cannot unduly adhere to the drum 31. As the multicolor toner image is transferred to and fixed on the recording paper P by means of a nip between the intermediate transfer drum 31 and the heating roll 51, therefore, production of vaporized gas attributable to the liquid carrier can be restricted, and the liquid carrier can be quickly vaporized by heat from the heating roll 51. Thus, the recording paper P need not be subjected to any post-treatment, such as drying.

Referring now to FIGS. 2 to 11, the developing unit 21, drive means 25, and toner cartridge 26 of the developing means 20 will be described.

Figure 2:
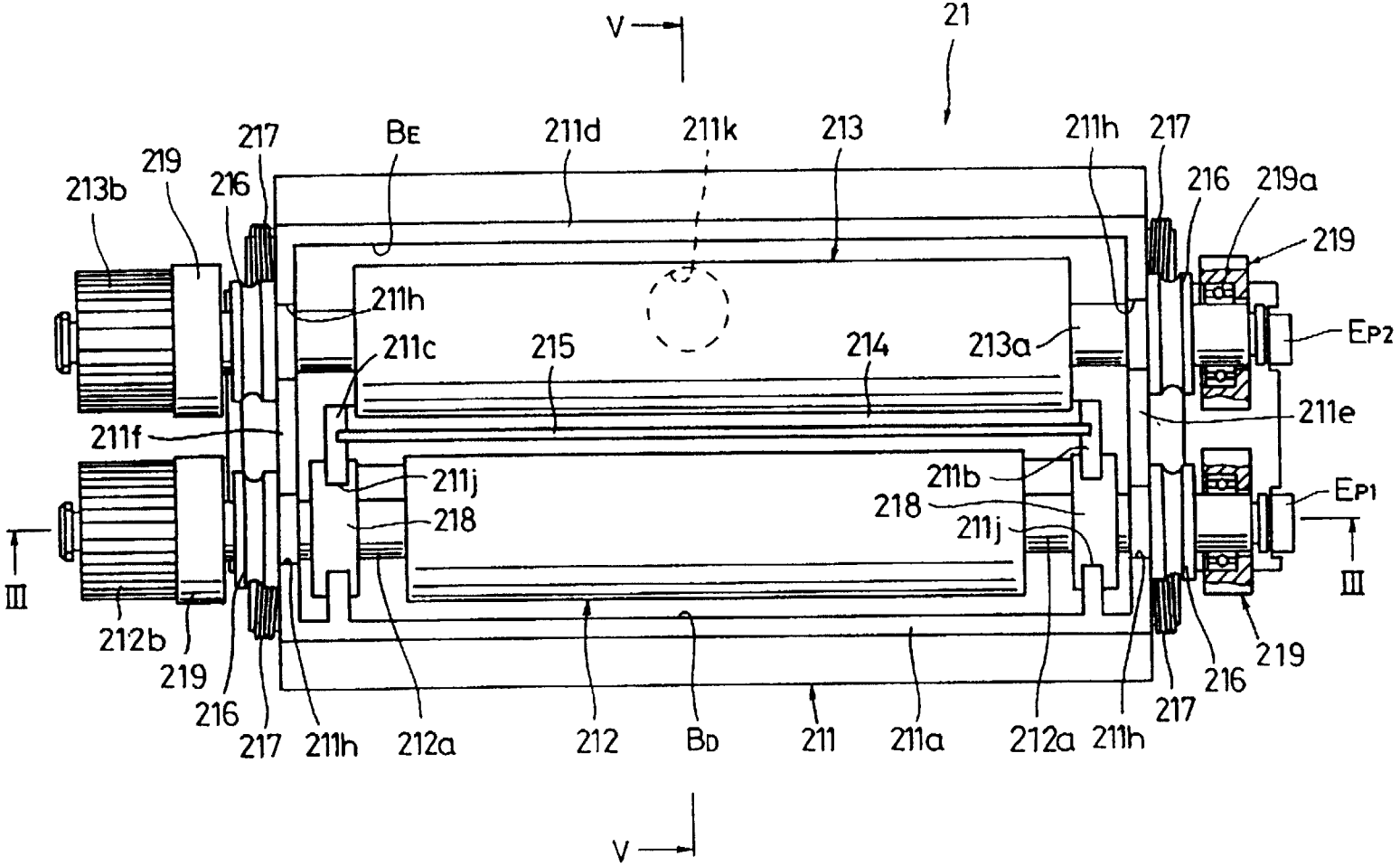
FIG. 2 is a plan view showing a developing roller and a squeeze roller included in developing means.
Figure 3:
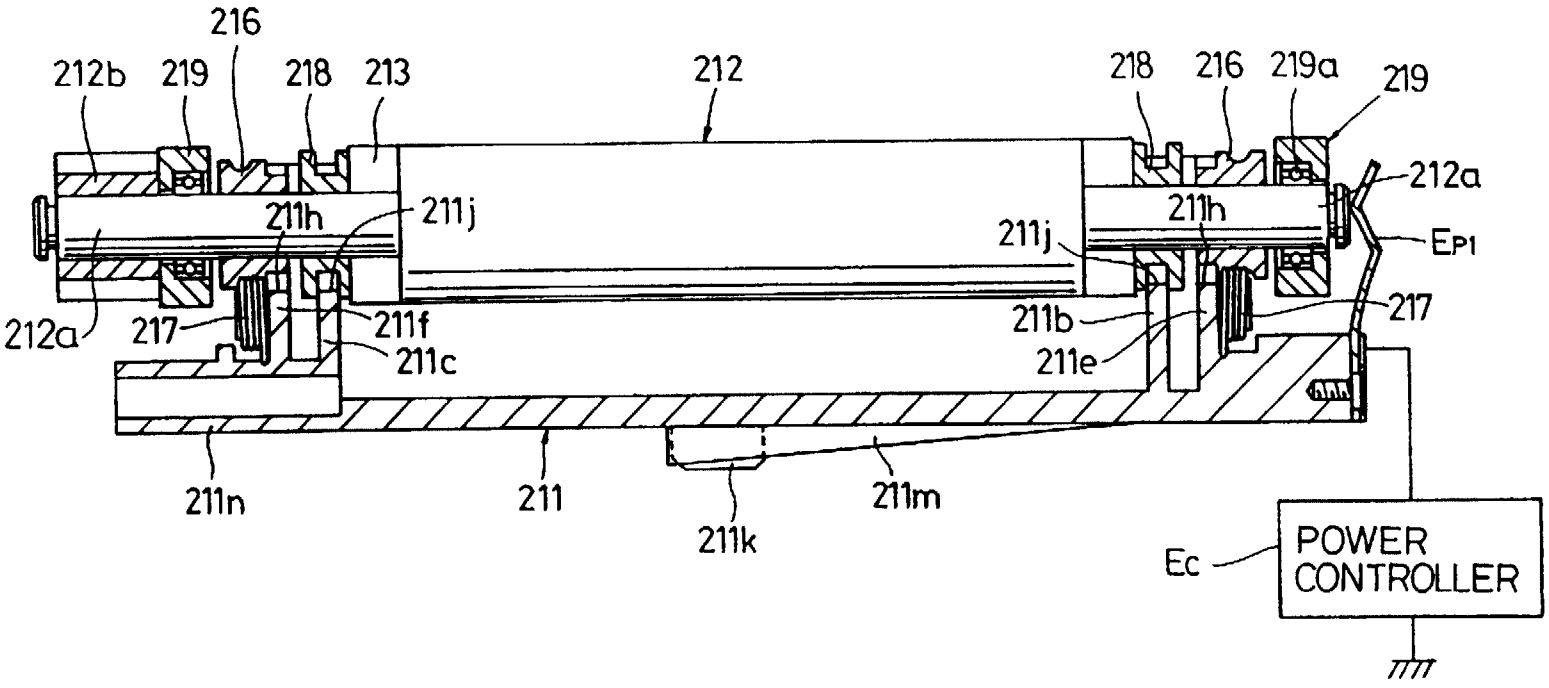
FIG. 3 is a sectional view of the developing means taken along line III—III of FIG. 2.
Figure 5:
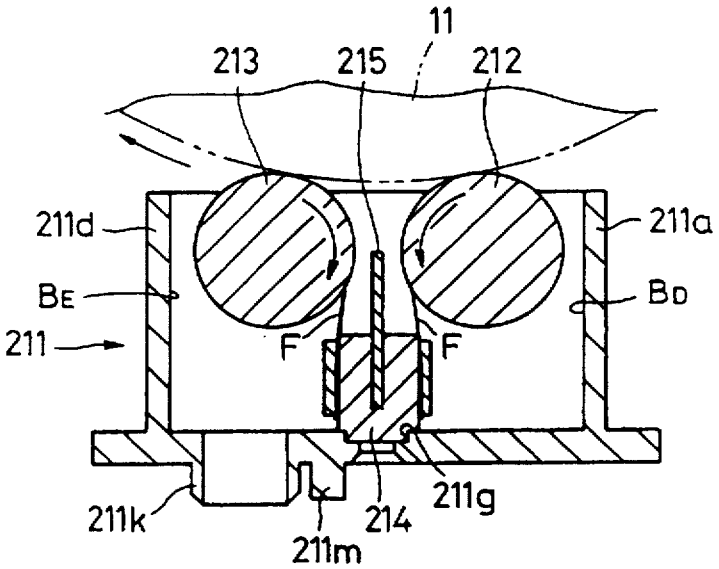
FIG. 5 is a sectional view of the developing means taken along line V—V of FIG. 2.

In the first developing unit 21, as shown in FIGS. 2, 3 and 5, the liquid tank 211 is divided into two compartments, a developing tank $B_D$ and a discharge tank $B_E$. The developing roller 212 is located in the developing tank BD, which is defined by a supporting member 214 longitudinally extending in the center, a partition 215 set up on the supporting member 214, and side walls **211*a*, 211*b* and 211*c*. The squeeze roller 213 is located in the discharge tank $B_E$, which is defined by the side wall 211*a* and side walls 211*d*, 211*e* and 211*f***.

As shown in FIG. 5, the supporting member 214 is fixed to a recess **211*g*, which is formed in the bottom wall of the liquid tank 211, and is provided with a plurality of small holes (not shown) which open into the discharge tank $B_E$. Further, the supporting member 214 is fitted, on the opposite side faces thereof, with plastic film sheets F which are arranged so that their respective upper ends abut against their corresponding rollers 212 and 213, thereby scraping off the liquid toner from the rollers. The film sheets F may alternatively be metallic. The liquid toner from the developing tank BD, having overflowed the partition 215, flows into discharge tank $B_B$ through the small holes in the supporting member 214**.

Figure 4:
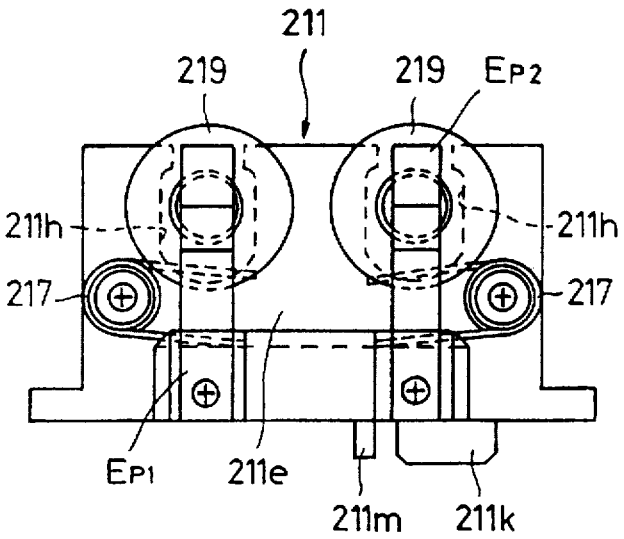
FIG. 4 is a right-hand side view of the developing means of FIG. 2.

As shown in FIG. 2 to 4, moreover, each of the side walls 211*e* and 211*f* is formed with a pair of narrow-topped slits 211*h*, and bearings 216 are attached individually to the slits 211*h*. The bearings 216, which individually support rotating shafts 212*a* and 213*a* of their corresponding rollers 212 and 213, are held in the slits 211*h* for slight up-and-down motion. A torsion coil spring 217 is interposed between each bearing 216 and the liquid tank 211, whereby each bearing 216 is urged upward. Since the top portion of each slit 211*h* is narrowed, the bearing 216 is prevented from being disengaged.

On the other hand, as shown in FIGS. 2 and 3, the side walls 211*b* and 211*c* are formed individually with slits 211*j* with the same width, and a pair of bearings 218 are attached individually to the slits 211*j* for up-and-down motion. The bearings 218 support the rotating shaft 212*a* of the developing roller 212 in a liquid-tight manner lest the liquid toner flow from the developing tank $B_D$ toward the discharge tank $B_E$.

In the liquid tank 211, as shown in FIGS. 3 to 5, moreover, a discharge port 211*k* through which the liquid toner is discharged into the toner cartridge 26 protrudes downward from the bottom wall of the discharge tank $B_E$, and a guide ridge 211*m* is formed on the bottom wall, adjoining the discharge port 211*k* and extending tapered toward the side wall 211*e*. The guide ridge 211*m* guides the toner cartridge 26 which is to be attached to the developing unit 21, thereby positioning the cartridge 26 with respect to the discharge port 211*k*. Further, as shown in FIG. 3, an inlet port 211*n* for the liquid toner supplied from the toner cartridge 26 is provided right under that portion of the rotating shaft 212*a* which is situated on the one side wall 211*f* of the developing roller 212.

As shown in FIGS. 2 and 3, a spacer roller 219 is mounted on each end of each of the respective rotating shafts 212*a* and 213*a* of the developing roller 212 and the squeeze roller 213. Also, gears 212*b* and 213*b* are mounted on one end of the shafts 212*a* and 213*a*, respectively.

The spacer rollers 219 are mounted on the rotating shafts 212*a* and 213*a* of the rollers 212 and 213 with the aid of bearings 219*a*, individually. The outside diameter of the rollers 219 is a little larger than that of the rollers 212 and 213. Thus, when the spacer rollers 219 are in sliding contact with their corresponding ends of the photosensitive drum 11, a predetermined gap is formed between the drum 11 and each of the rollers 212 and 213. In the electrophotographic printer 1 of the present embodiment, the gap between the drum 11 and the developing roller 212 is adjusted to 100 μm, and the gap between the drum 11 and the squeeze roller 213 to 50 μm, for example. Developing rollers 222 232, and 242 of developing units 22, 23, and 24, respectively operate in a manner similar to developing roller 212. Further, squeeze rollers 223, 233, and 243 of developing units 22, 23, and 24, respectively, operate in a manner similar to squeeze roller 232.

As shown in FIGS. 2 to 4, moreover, the respective upper ends of electrode plates $E_{P1}$ and $E_{P2}$ are pressed against those end faces of the rotating shafts 212*a* and 213*a* of the rollers 212 and 213 on the side of the side wall 211*e*, respectively, while the respective lower ends of the electrode plates $E_{P1}$ and $E_{P2}$ are connected to a power controller $E_C$ for voltage supply.

Figure 6:
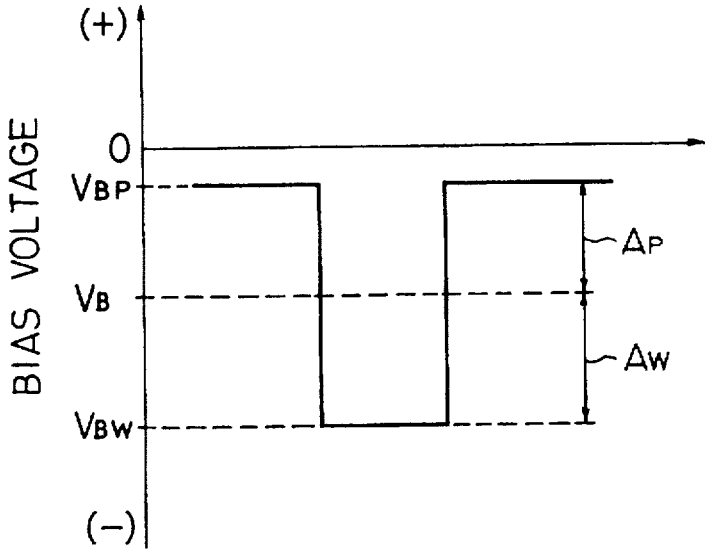
FIG. 6 shows a potential characteristic curve illustrating between the surface potential of a photosensitive drum and the developing bias voltage applied to the developing roller.

The one electrode plate $E_{P1}$ applies a developing bias voltage to the developing roller 212. In changing the developing units for developing the electrostatic latent images on the photosensitive drum 11, the bias voltage is increased from the white-ground area side to the print area side. Normally, as shown in FIG. 6, a developing bias voltage $V_B$ (about −300 to −500 V) is applied to the developing roller 212 so that a photosensitive drum surface potential $V_{BW}$ for a white-ground area $A_W$ ranges from about −500 to −700 V, and a photosensitive drum surface potential $V_{BP}$ for a print area $A_P$ is about −100 V.

In changing the developing units, the bias voltage applied to the developing roller 212 is positively increased from the white-ground area side to the print area side. As a result, the surplus liquid toner is removed from the surface of the photosensitive drum 11, so that the squeezing performance against the liquid toner is improved. Thus, the surplus liquid toner, especially the liquid carrier, can be prevented from adhering to the intermediate transfer drum 31.

Figure 7:
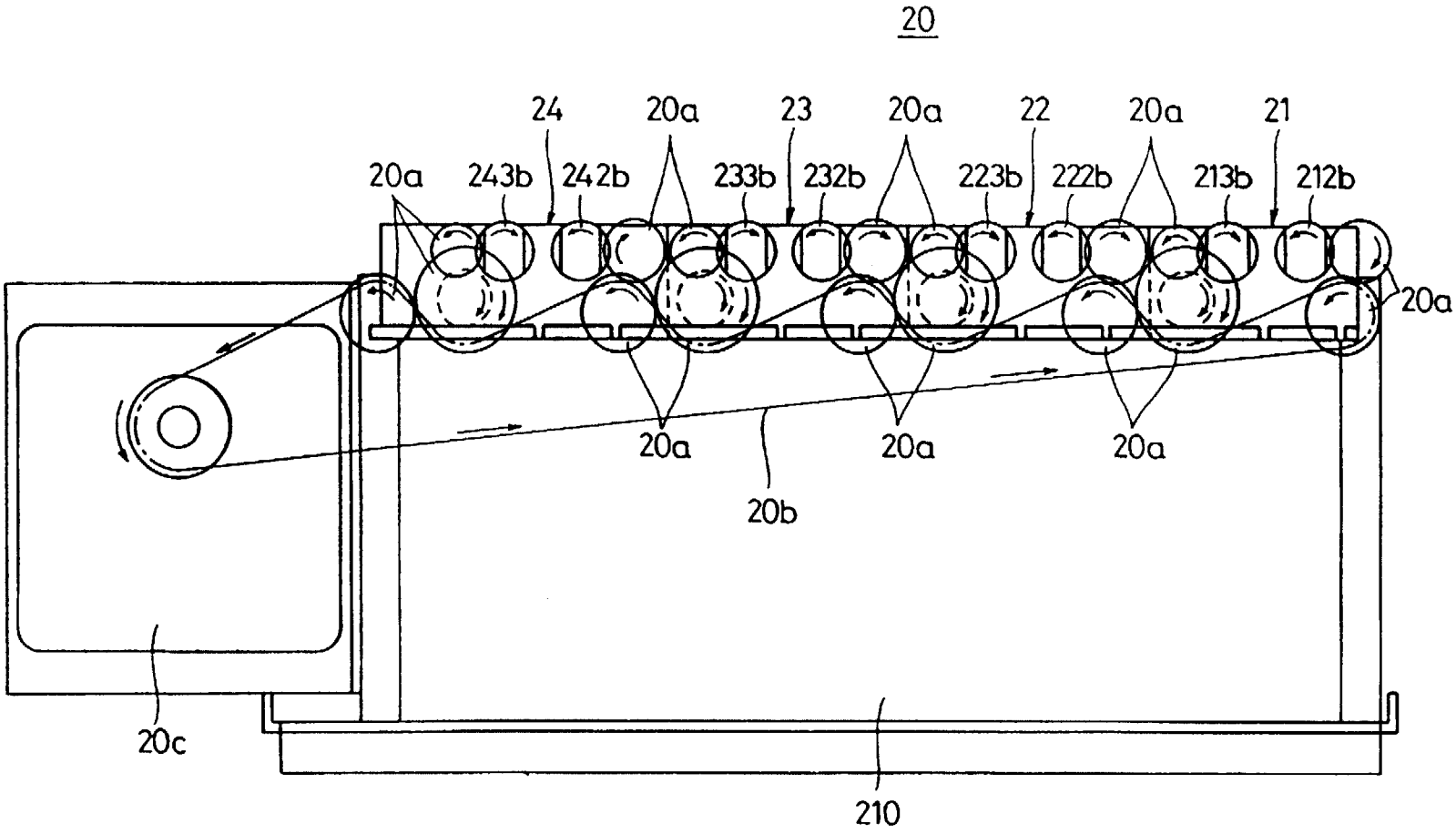
FIG. 7 is a rear view of the electrophotographic printer shown in FIG. 1.

As shown in FIG. 7, the rotation of a drive motor 20*c* is transmitted to the gears 212*b* and 213*b* mounted on their corresponding rollers 212 and 213, along with gears on the other developing units 22 to 24 on the rear side of the electrophotographic printer 1, by means of a timing belt 20*b* which is passed around a plurality of transmission members 20*a* each formed of an intermediate gear or timing pulley. Thus, in the developing units 21 to 24, the developing roller 212 are rotated in the direction opposite to the rotating direction of the photosensitive drum 11, while the squeeze roller 213 is rotated in the same direction as the drum 11, as indicated by the arrows in FIG. 1 and 5.

Gears 222*b* and 223*b*, 232*b* and 233*b*, and 242*b* and 243*b*, of developing units 22, 23, and 24, respectively, operate in a manner similar to gears 212*b* and 213*b*.

By adjusting the number of teeth of each transmission member 20*a*, the respective rotating speeds of the developing rollers and the squeeze rollers of developing units 21 to 24 are set so as to be, for example, five times and three times, respectively, as high as that of the photosensitive drum 11. If the rotating speed of each roller is set in this manner, the liquid toner supply to the drum 11 and squeezing the liquid toners on the drum 11 are well-balanced, so that the electrostatic latent images can be developed under optimum conditions.

Thus, in the first developing unit 21, the electrostatic latent image formed on the photosensitive drum 11 is developed with use of the liquid toner supplied to the drum 11 by means of the developing roller 212, the surplus liquid toner adhering to the drum 11 is squeezed, and the developed toner image is transferred to the intermediate transfer drum 31. The same processes are executed for the other developing units 22 to 24.

Meanwhile, the liquid toner fed from the toner cartridge 26 is supplied to the developing tank $B_D$ through the inlet port 211*n* of the liquid tank 211. The liquid toner overflowing the partition 215 and the liquid toner flowing down along that film sheet F which abuts against the squeeze roller 213 flow into the discharge tank $B_E$ through the small holes in the supporting member 214, then flow back to the toner cartridge 26 through the discharge port 211*k*.

Figure 8:
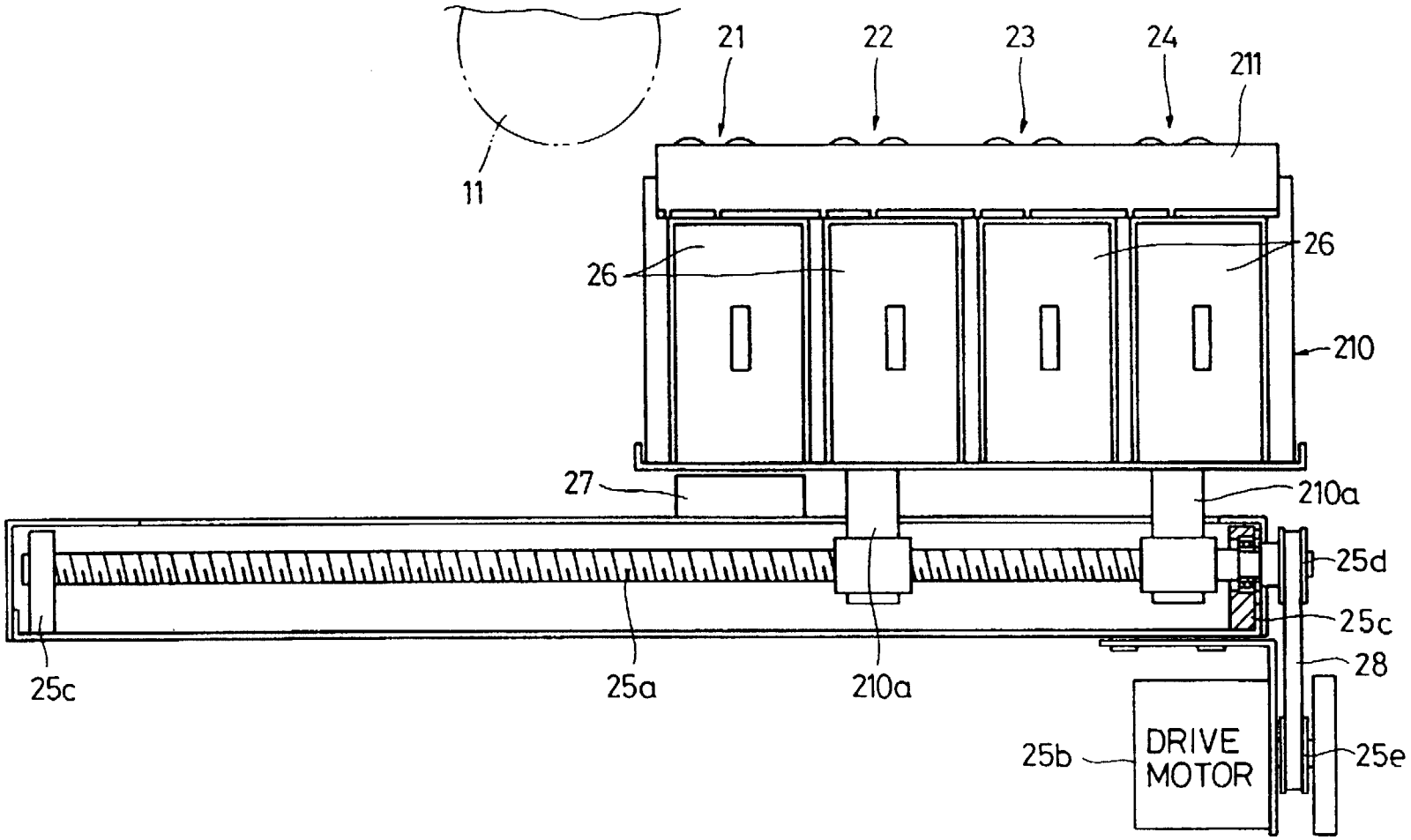
FIG. 8 is a front view showing drive means for integrally moving developing units of the electrophotographic printer of FIG. 1.

Referring now to FIG. 8, the drive means 25 for moving the developing units 21 to 24 in a body from side to side will be described.

The drive means 25 includes the ball screw 25*a* and the drive motor 25*b* for rotating the screw 25*a*. The ball screw 25*a* is rotatably supported, at both ends thereof, on a pair of supporting brackets 25*c*, and is screwed in a plurality of supporting members 210*a* which, arranged at the lower portion of the housing 210, serve also as nuts. The ball screw 25*a* is rotated by means of a belt 28, which is passed around and between a pulley 25*d* on one end of the screw 25*a* and a pulley 25*e* of the drive motor 25*b*. Thus, the developing units 21 to 24 of the developing means 20 are moved in a body from side to side.

When the developing units 21 to 24 are moved to the left of FIG. 8, the first developing unit 21 first engages the photosensitive drum 11. In this state, as shown in FIGS. 2 to 4, the developing roller 212 and the squeeze roller 213 are supported by their corresponding bearings 216, which are held in the slits 211*h* of the liquid tank 211 for slight up-and-down motion, the bearings 216 are urged upward by the torsion coil springs 217, individually, and the spacer rollers 219 are mounted on their corresponding rotating shafts 212*a* and 213*a*.

Thus, the spacer rollers 219 on the rotating shaft 212*a* of the developing roller 212, for example, first come into sliding contact with their corresponding ends of the photosensitive drum 11. When the first developing unit 21 further moves to the left from this position, a downward force of pressure acts on the developing roller 212 through the medium of the spacer rollers 219.

Thereupon, the bearings 216, which support the rotating shaft 212*a* of the developing roller 212, moves slightly downward in their corresponding slits 211*h*, whereby the developing roller 212 dodges the photosensitive drum 11 so that the predetermined gap is secured between the roller 212 and the drum 11 by means of the spacer rollers 219. In this manner, the first developing unit 21 is moved to a developing position such that the photosensitive drum 11 is situated between the developing roller 212 and the squeeze roller 213.

Further, the squeeze roller 213 behaves in the same manner as the developing roller 212, avoiding the photosensitive drum 11, as the developing unit 21 moves to the left so that it is replaced by the developing unit 22.

When replacing one developing unit with another, the rotation of each developing roller is stopped, and the developing units 21 to 24 are then moved together to the left by means of the drive means 25. More specifically, when the developing unit 21, having developed the electrostatic latent image on the photosensitive drum 11, is replaced with the next developing unit 22, the developing roller 212 stops, and no liquid toner is supplied to the drum 11. Thus, the photosensitive drum 11 cannot be supplied with any excessive liquid toner.

Besides the liquid toner squeezing effect of the squeeze roller 213 which approaches following the developing roller 212, therefore, the above effect prevents surplus liquid toners from adhering the photosensitive drum 11, and the squeezing performance to remove the liquid toners from the drum 11 is further improved. Thus, no liquid toners enter the spaces between the adjacent developing units, so that the liquid toners cannot be soiled by one another.

In the developing means 20 constructed in this manner, all the developing units 21 to 24 can be changed or restored to their initial position by only being moved in one horizontal direction tangential to the photosensitive drum 11, as indicated by the arrow in FIG. 1. Accordingly, the developing means 20 need not undergo complicated motion such that all the developing units are also moved in the vertical direction to avoid the photosensitive drum 11. In addition to the easy positioning of the developing units 21 to 24 with respect to the drum 11, moreover, the construction of the drive means 25 can be simplified, and the liquid toners can be prevented from getting into the spaces between the developing units 21 to 24.

Figure 9:
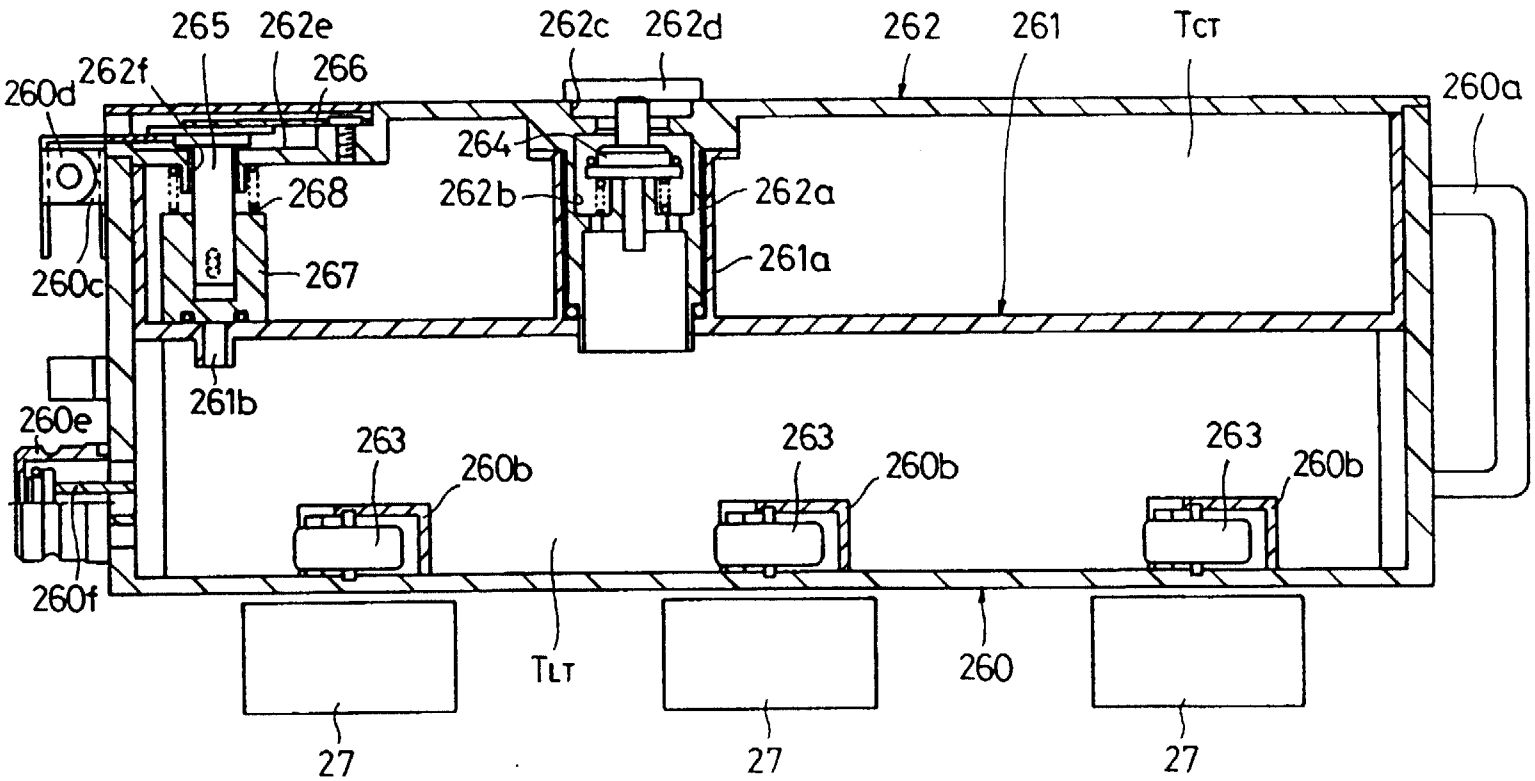
FIG. 9 is a sectional view showing a toner cartridge of one of the developing units.
Figure 10:
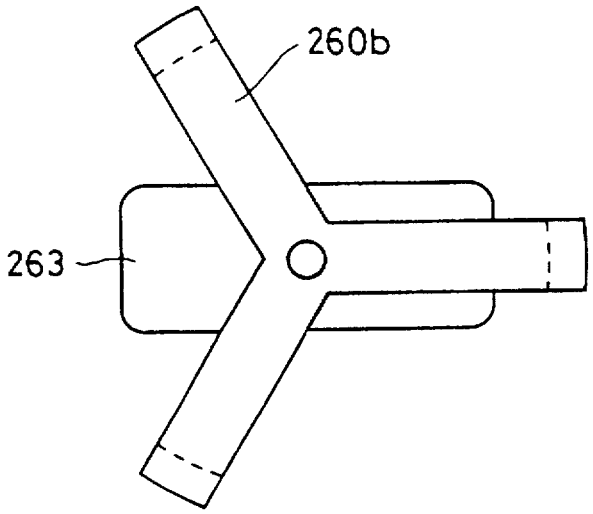
FIG. 10 is a plan view of a magnetic rotor in the toner cartridge.
Figure 11:
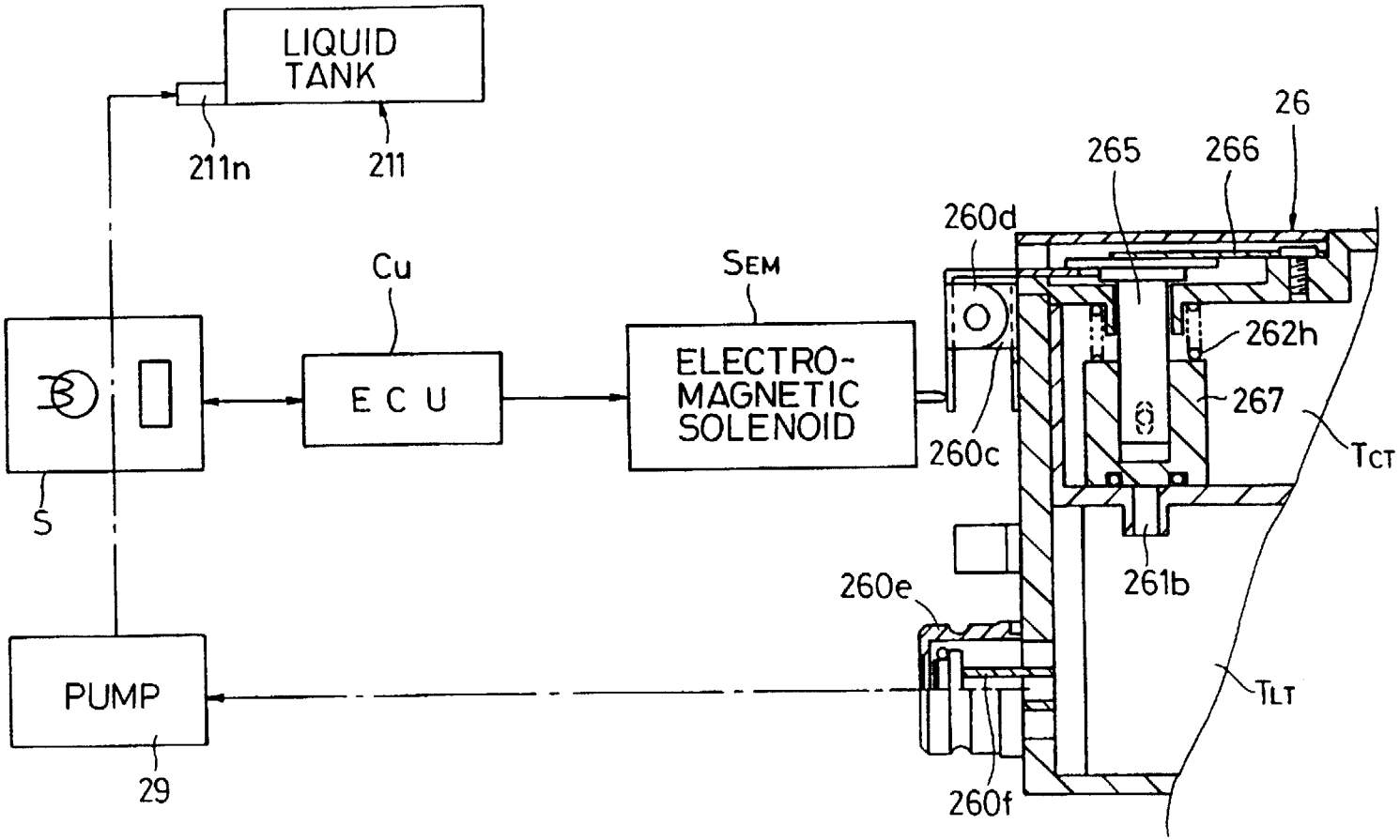
FIG. 11 is a block diagram showing a mechanism for adjusting the concentration of a liquid toner fed from each toner cartridge to its corresponding developing unit.

Referring now to FIGS. 9 to 11, the toner cartridge 26 will be described. The toner cartridge 26 is a disposable cartridge which is removably attached to the housing of each developing unit. The cartridge 26 comprises a rectangular casing 260, a partition wall 261 vertically dividing the casing 260, and a cover plate 262. A concentrated toner tank $T_{CT}$ for containing a concentrated toner is defined in the upper portion of the cartridge 26, and a liquid toner tank $T_{LT}$ for containing a developing liquid toner in the lower portion.

The casing 260 has a grip 260*a* on its front face. Arranged at the bottom of the casing 260 are three supporting members 260*b* for individually supporting magnetic rotors 263 for rotation. Each supporting member 260 has three supporting pieces which radially spread from the center. Each magnetic rotor 263 is rotated by means of each corresponding one of drive units 27 which are arranged facing the developing unit, substantially corresponding to the middle of the ball screw 25*a*, as shown in FIGS. 1, 8 and 9. The drive units 27 generate rotating magnetic fields when supplied with AC current, thereby rotating their corresponding magnetic rotors 263 to stir the liquid toner in the liquid toner tank $T_{LT}$.

Also, the casing 260 has a supporting bracket 260*c* on the upper portion of its rear wall, and an L-shaped lever 260*d* is rotatably mounted on the bracket 260*c*. The lever 260*d* is formed with a push portion on its right-angled side and a forked lift portion on the other side, which is adapted to engage a plug 265 (discussed later). As the push portion is depressed, the lever 260*d* turns and lifts the plug 265.

Further, the casing 260 is provided with a feed port 260*e* below the supporting bracket 260*c*. The liquid toner is fed through the port 260*e* into each corresponding one of liquid tanks 211 to 241 above. A valve 260*f* and a spring are arranged in the feed port 260*e* in a manner such that the valve 260*f* is closed by the spring, thereby closing the port 260*e*. When the toner cartridge 26 is attached to the housing of each developing unit, the feed port 260*e* is connected to a socket (not shown) formed in the housing, and the valve 260*f* is opened resisting the urging force of the spring. Thereupon, the liquid toner is discharged through the port 260*e* into a pump 29, which will be discussed later.

The partition wall 261 is formed having a cylindrical receiving portion 261*a* in the center, extending in the vertical direction. On the side of the supporting bracket 260*c*, the wall 261 has an outlet port 261*b* through which the concentrated toner in the concentrated toner tank $T_{CT}$ flows out into the liquid toner tank $T_{LT}$.

The cover plate 262 is formed having a reflux tube 262*a* in the center, which corresponds to and vertically communicates with the receiving portion 261*a*. Formed in the center of the tube 262*a* is a valve chamber 262*b* which contains a valve 264. The valve 264 is closed by being pushed up by means of a spring. As the toner cartridge 26 is inserted into the housing 210, the valve 264 is pressed downward by the tapered guide ridge 211*m* on the liquid tank 211 of the developing unit 21, so that a passage from the discharge port 211*k* to an opening 262*c* is opened. Further, the cover plate 262 is formed having a recess 262*e* on the side of the supporting bracket 260*c*, and a fitting hole 262*f* is formed in the recess 262*e*. The plug 265 is fitted in the hole 262*f*.

The top of the plug 265 is pressed by means of a leaf spring 266, which is mounted on the peripheral edge of the recess 262*e*, and the plug 265 is pulled up as the lever 260*d* is turned. A valve 267 is telescopically fitted on the plug 265 for sliding motion. The valve 267, which is urged downward by a spring 268, closes the outlet port 261*b* in the partition wall 261.

The liquid toners are supplied from the individual toner cartridges 26 to their corresponding developing units 21 to 24 only when the electrophotographic printer 1 is to be used or operated. Normally, the liquid tanks 211 to 241 of developing units 21 to 24 contain no liquid toner. The magnetic rotors 263, which are rotated by means of their corresponding drive units 27 when the printer 1 is connected to the power supply to be energized, for example, serve to stir the liquid toners, thereby uniformly dispersing the deposited toner particles in the liquid carrier.

Thus, in the toner cartridge 26 set in position in the housing 210, as shown in FIG. 11, the liquid toner in the liquid toner tank $T_{LT}$ is delivered through the feed port 260*e* to the developing unit 21 above by the pump 29, and is then fed through the inlet port 211*n* into the liquid tank 211. The liquid toner, having its concentration lowered after developing in the developing unit 21, flows back to the liquid toner tank $T_{LT}$ via the discharge port 211*k* of the liquid tank 211 and the reflux port 262*c*.

In the meantime, the concentration of the liquid toner fed into the liquid tank 211 is detected by means of a concentration sensor S arranged between the pump 29 and the liquid tank 211. If the concentration is low, a command signal is delivered from a control unit (ECU) $C_U$. In response to this command signal, the electromagnetic solenoid SEM is energized for a short period of time, and is activated to press the lever 260*d* on the toner cartridge 26, thereby pulling up the plug 265 together with the valve 267, resisting the urging force of the leaf spring 266, only during the conduction period.

Thereupon, the highly concentrated toner in the concentrated toner tank $T_{CT}$ flows out of the outlet port 261*b* into the liquid toner tank $T_{LT}$, so that the concentration of the liquid toner supplied to the developing unit 21 increases. This supply of the concentrated toner is repeated so that the concentration of the toner supplied to the developing unit 21 increases to a predetermined value.

In this manner, liquid toner of a predetermined concentration is supplied from each toner cartridge 26 to its corresponding developing unit. When the concentrated toner in the concentrated toner tank $T_{CT}$ is used up, the toner cartridge 26 is drawn out of the housing 210 and abandoned, and a new toner cartridge 26 is attached.

The toner cartridge 26 can be a disposable unit because the drive units 27 are arranged on the housing 210, while the magnetic rollers 263 are located inside. Since the liquid toner tank $T_{LT}$ and the concentrated toner tank $T_{CT}$ are formed integrally with each other, moreover, they need not be separately connected to the electrophotographic printer 1. Thus, the number of junctions between each toner cartridge 26 and the printer 1 can be lessened, so that the printer 1 can be simplified in construction, and its components can be reduced in number.

Further, the developing means 20 is provided with squeeze means for removing the surplus liquid toners from the photosensitive drum 11. Referring now to FIGS. 12 to 15, the squeeze means will be described.

The squeeze means 80 comprises a squeeze blade 81 and a supporting shaft 82, which are provided for each developing unit, as well as a drive rack member 83, a rotary solenoid 84, and a guide member 85.

Figure 12:
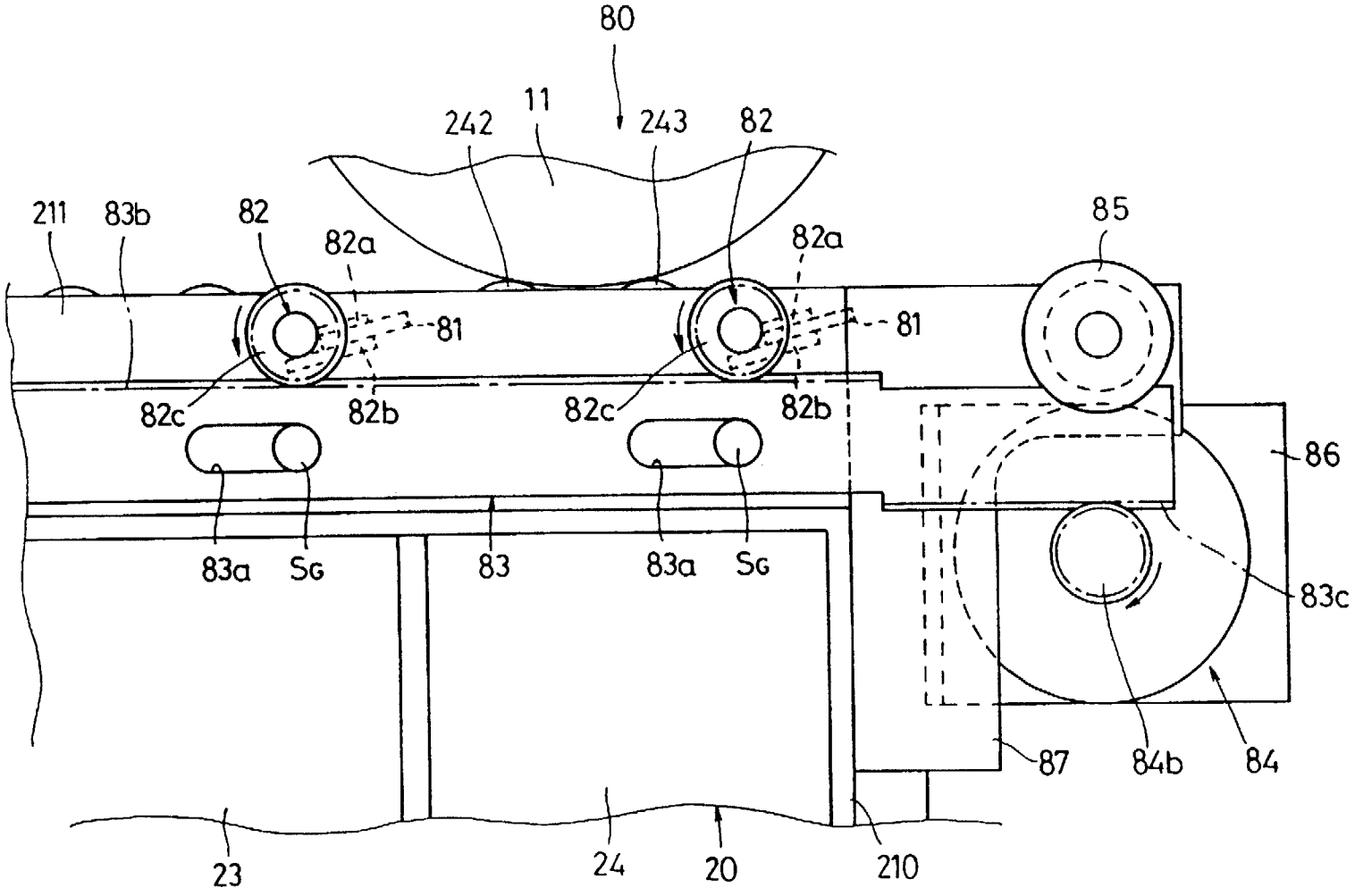
FIG. 12 is a front view showing the principal part of squeeze means separately provided for the electrophotographic printer.
Figure 15:
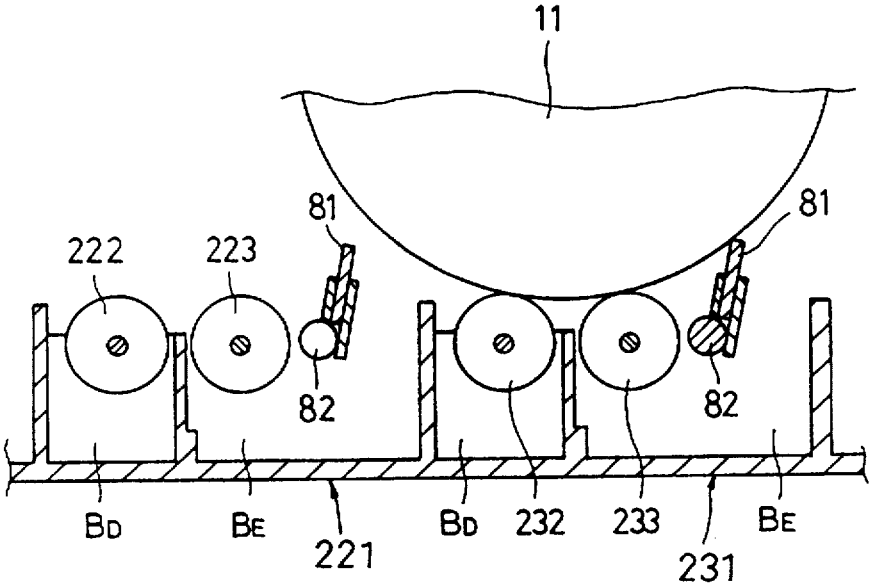
FIG. 15 is a front view, partially in section, showing the principal part of the squeeze means.

As shown in FIGS. 12 and 15, each squeeze blade 81 is mounted on a each corresponding supporting shaft 82 by means of mounting plates 82*a* and 82*b*. Normally, the blade 81 is substantially horizontal so that it is not in contact with the photosensitive drum 11, as shown in FIG. 12.

Figure 14:
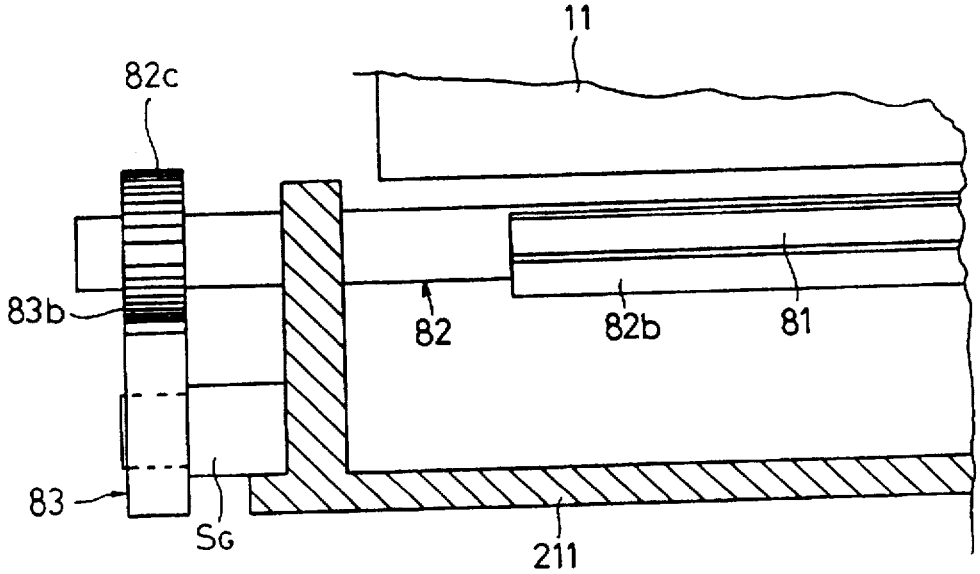
FIG. 14 is a side view, partially in section, showing the principal part of the squeeze means.

Each supporting shaft 82 extends along the longitudinal direction of each corresponding squeeze roller so as to be adjacent thereto, in its corresponding liquid tank of the developing means 20. As shown in FIGS. 12 and 14, a pinion 82*c* is mounted on an end portion of the supporting shaft 82 which projects from the front of each corresponding one of liquid tanks 211 to 241.

The drive rack member 83 extends horizontally from side to side along the developing units 21 to 24, in front of the liquid tanks 211 to 241. The rack member 83 is provided with a plurality of guide slots 83*a* in which are fitted on a plurality of guide shafts $S_G$ on the respective side faces of the liquid tanks 211 to 241, individually. A rack 83*b*, which is provided on the upper end of the drive rack member 83, meshes with the pinions 82*c* on the individual supporting shafts 82. Also, a rack 83*c* is provided on one side of the lower end of the rack member 83.

Figure 13:
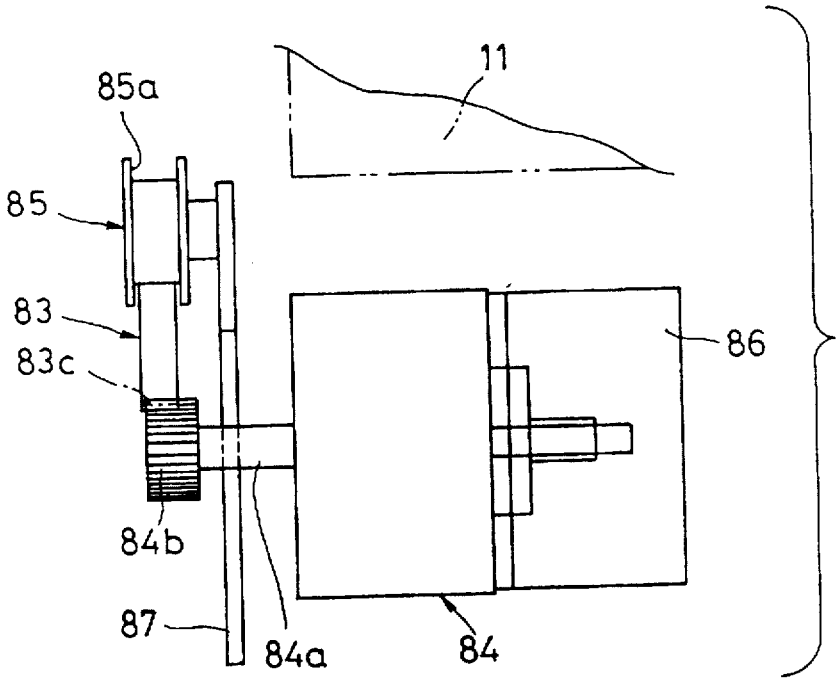
FIG. 13 is a right-hand side view of the squeeze means shown in FIG. 12.

As shown in FIGS. 12 and 13, the rotary solenoid 84 is supported on a mounting plate 86, which is provided on the housing 210 of the developing means 20, and a pinion 84*b* is mounted on the distal end of a drive shaft 84*a* of the solenoid 84. The drive shaft 84*a* protrudes toward a supporting bracket 87 which is mounted on the housing 210 at the back of the drive rack member 83, and the pinion 84*b* meshes with the rack 83*c* of the rack member 83.

In a position right over the rotary solenoid 84, moreover, a guide member 85 is mounted on top of the supporting bracket 87. The guide member 85, which is a bobbin-shaped member having an annular groove 85*a* on its outer peripheral surface, holds the upper end of the drive rack member 83, and guides the member 83 which is being moved along the liquid tanks 211 to 241 by means of the rotary solenoid 84.

The squeeze means 80 operates in the following manner when the developing units 21 to 24 are changed.

When the rotary solenoid 84 is first energized, the drive shaft 84*a*, along with the pinion 84*b*, turns for a predetermined angle in the clockwise direction of FIG. 12. As the pinion 84*b* turns in this manner, the drive rack member 83 moves to the right for a predetermined distance. At this time, the rack member 83 moves in the horizontal direction, guided by the guide member 85 and the guide shafts $S_G$ fitted in the slots 83*a*.

As the drive rack member 83 moves in this manner, the pinions 82*c*, which mesh with the rack 83*b*, turn together with their corresponding supporting shafts 82 in the counterclockwise direction, as indicated by the arrows in FIG. 12. Thereupon, the squeeze blades 81 on the supporting shafts 82 are substantially vertical, as shown in FIG. 15, and come into contact with the surface of the photosensitive drum 11 on the bottom side thereof.

When the developing units in this state are moved to the left of FIG. 15, the squeeze blades 81 remove the surplus liquid toner on the photosensitive drum 11. When the developing units 21 to 24 are changed, therefore, the liquid toner in the adjacent liquid tanks cannot be mixed with each other. Accordingly, the liquid toners cannot be soiled by one another, so that the resulting color print is clearer. By removing the surplus liquid toner from the photosensitive drum 11 in this manner, moreover, the surplus liquid toners, especially the liquid carrier containing the dispersed toner particles, can be prevented from adhering to the intermediate transfer drum 31. Thus, in transferring the toner images to the recording paper P by means of the heating roll 51, the vaporized gas resulting from the liquid carrier can be restrained from being discharged to the outside of the electrophotographic printer 1.

Preferably, current supply to the rotary solenoid 84 is continued until the point time immediately before the electrostatic latent image formed on the photosensitive drum 11 by means of the latent image forming means $M_H$ reaches the developing roller of the developing unit newly set after the replacement, e.g., a developing roller 232 of the developing unit 23. By doing this, the liquid toners on the drum 11 can be thoroughly removed in a transient state before a squeeze roller 233 of the developing unit 23 produces its liquid toner squeezing effect after the shift from the developing unit 22 to the unit 23, so that the production of the vaporized gas can be restrained more effectively.

Figure 16:
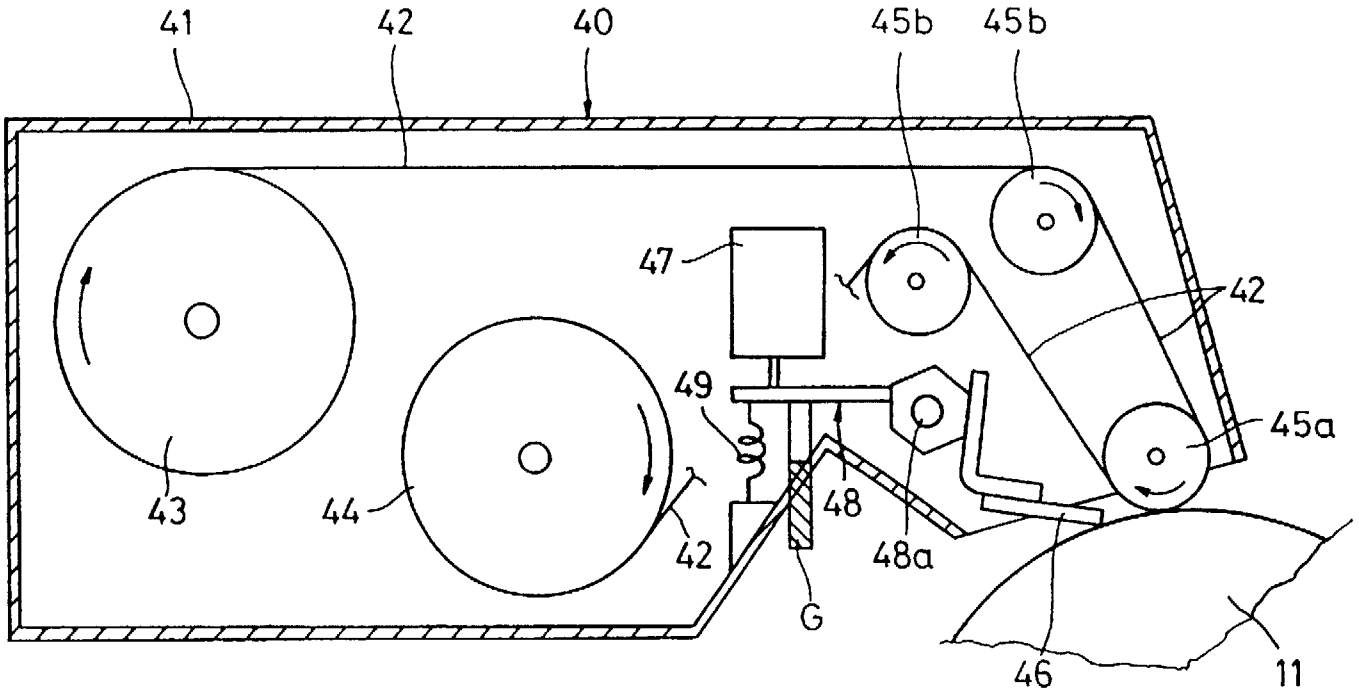
FIG. 16 is a front view, partially in section, showing cleaning means in the electrophotographic printer.

Referring now to FIG. 16, the construction of the cleaning means 40 will be described further in detail. The cleaning means 40 comprises a housing 41, which contains a feed roller 43 wound with a nonwoven fabric 42, a take-up roller 44, a plurality of intermediate rollers 45 threaded with the fabric 42 from the feed roller 43 and serving to guide it to the take-up roller 44, and a cleaning blade 46. When the toner images are transferred from the photosensitive drum 11 to the intermediate transfer drum 31, the cleaning means 40 cleans the drum 11 in a manner such that the slight residual toner images and liquid toner (several percent of the toner images and liquid toners developed on the drum 11) remaining on the drum 11 are scraped up by means of the cleaning blade 46, and are soaked up with the nonwoven fabric 42.

The nonwoven fabric 42 from the feed roller 43 is passed around the intermediate rollers 45 and wound on the take-up roller 44. The intermediate rollers 45 include a contact roller **45*a* and guide rollers 45*b*. The contact roller 45*a* is brought intermittently into contact with the photosensitive drum 11 by urging means (not shown). The take-up roller 44, which is intermittently rotated by drive means (not shown), is used to wipe out leavings, such as the residual toner images and liquid toner, on the photosensitive drum 11. The cleaning blade 46, which is formed of urethane rubber, is attached to the distal end of an arm 48, which turns around a shaft 48*a*. Normally, the proximal end of the arm 48 is pulled down by a spring 49 so that the blade 46 is kept apart from the photosensitive drum 11. When the cleaning means 40 is attached to the electrophotographic printer 1, the arm 48 is pushed up slightly from the proximal end side by a tapered guide projection G on the printer side. As a result, the distal end of the cleaning blade 46 is pressed against the drum 11 with a relatively low force, as shown in FIG. 16**.

When the individual developing units start their developing operation, and when the photosensitive drum 11 starts to rotate, an electromagnetic solenoid 47 of the electrophotographic printer 1 is energized further to pull up the proximal end of the arm 48. Thereupon, the distal end of the cleaning blade 46 is pressed against the drum 11 with greater force, and the blade 46 scrapes off the traces of the toner images and liquid toner transferred to the intermediate transfer drum 31, thereby cleaning the surface of the photosensitive drum 11. The residual toner images and liquid toner, scraped off in this manner, are wiped off and removed from the surface of the drum 1 by means of the nonwoven fabric 42.

Thus, the cleaning means 40 cleans the photosensitive drum 11 as the take-up roller 44 rotates intermittently. When the nonwoven fabric 42 is used up, the housing 41 is removed from the electrophotographic printer 1 and abandoned, and the cleaning means 40 is replaced with a new one.

With use of the cleaning means 40 constructed in this manner, therefore, the photosensitive drum 11 can be prevented from being soiled by the residual toner images and liquid toner, so that the developing performance for a new electrostatic latent image can be improved. Further, the cleaning blade 46 is pressed with a great force against the photosensitive drum 11 only during the rotation of the drum 11, and therefore, degradation of the drum 11 is less and the service life of the drum is longer as compared with the case where the cleaning blade is always pressed against the drum 11. Since the cleaning blade 46 serves as a seal by continually engaging the photosensitive drum 11, moreover, the leavings such as the residual toner images, having failed to be wiped out by means of the nonwoven fabric 42, are prevented from flowing out along the surface of the drum 11 toward the discharger 12, and therefore, from soiling the toner images formed by the developing means 20.

Figure 17:
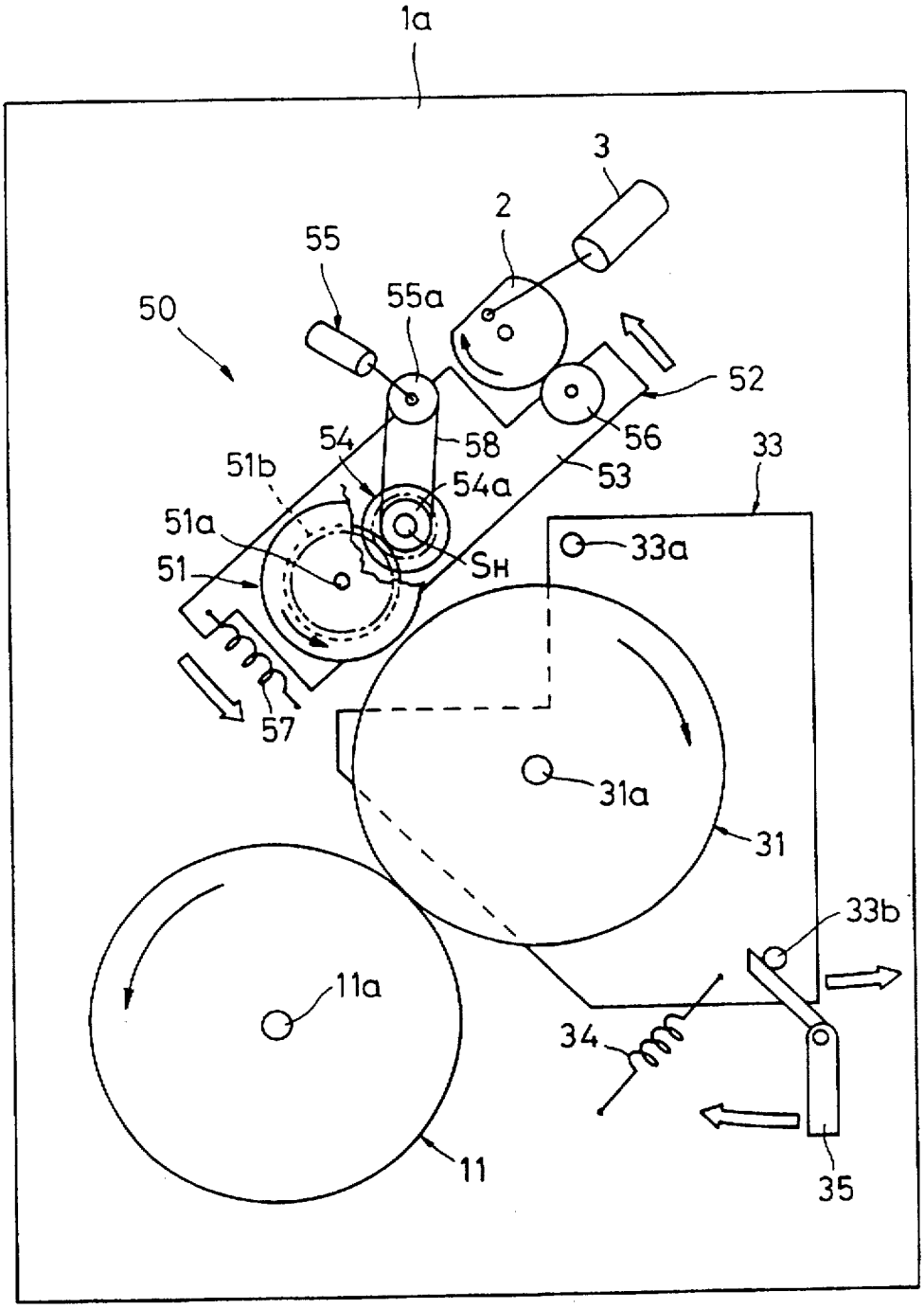
FIG. 17 is a general view showing a push mechanism for transfer-fixing means in a state such that the transfer-fixing means is kept apart from an intermediate transfer drum.
Figure 18:
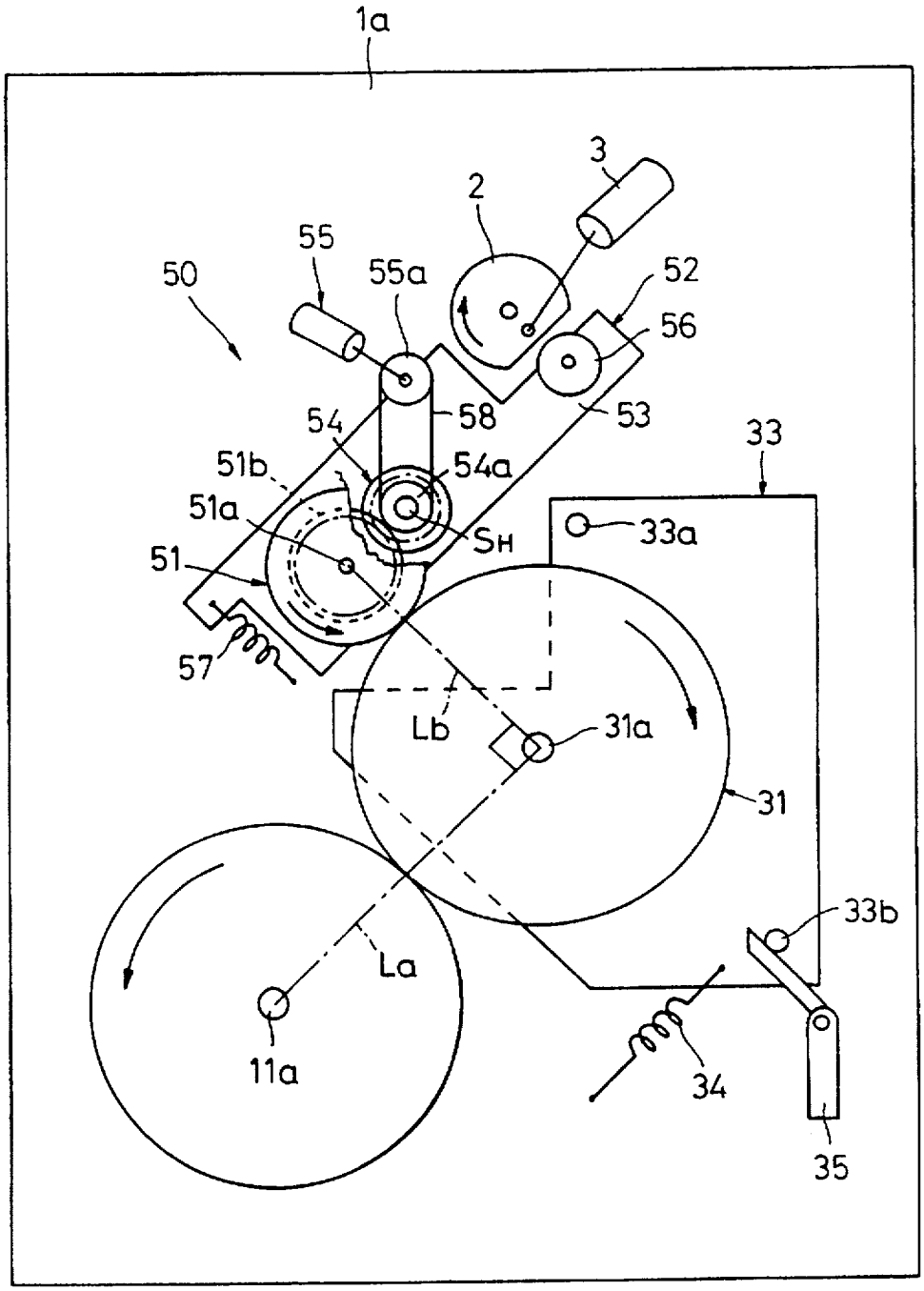
FIG. 18 is a general view similar to FIG. 17, showing a state such that the transfer-fixing means is pressed against the intermediate transfer drum.

Referring now to FIGS. 17 and 18, the push mechanism 52 of the transfer-fixing means 50 will be described. The push mechanism 52 includes the heating roll 51, a gear 54, a drive motor 55, a bearing 56, etc., supported on a supporting base 53 which is mounted on a body **1*a* of the electrophotographic printer 1 for rocking motion with respect to the intermediate transfer drum 31**.

The heating roll 51, which is supported on one side of the supporting base 53, is pressed against the intermediate transfer drum 31 as the base 53 rocks. A substantially central portion of the base 53 is supported diagonally above the drum 31 for rocking motion by means of a shaft $S_H$. The supporting base 53 is urged toward the intermediate transfer drum 31 by means of a spring 57, one end of which is anchored to the printer body **1*a*, and the other end to the one side of the base 53. The gear 54, along with a pulley 54*a* integral therewith, is rotatably supported by the shaft $S_H$, and meshes with a gear 51*b* which is mounted on one end of a shaft 51*a* of the heating roll 51. The drive motor 55 causes the heating roll 51 to be rotated by a belt 58 which is passed around and between a pulley 55*a* fixed to the rotating shaft of the motor 55 and the pulley 54*a* of the gear 54. The bearing 56, which is pivotally supported on the other side of the supporting base 53, is pressed by an eccentric cam 2, which is mounted on the printer body 1*a*, so that the base 53 is rocked in the clockwise direction around the shaft $S_H$, thereby separating the heating roll 51 from the intermediate transfer drum 31. The eccentric cam 2 is turned by means of a drive motor 3** on the printer body side with the aid of a gear system (not shown).

Constructed in this manner, the push mechanism 52 operates as follows. While the toner images are being successively transferred to the intermediate transfer drum 31 after the electrostatic latent images on the photosensitive drum 11 are developed by means of the developing units 21 to 24, the eccentric cam 2 presses the bearing 56, thereby keeping the heating roll 51 apart from the intermediate transfer drum 31, as shown in FIG. 17. At this time, the supporting base 53 is subjected to the force of the spring 57 to urge it counterclockwise around the shaft $S_H$, as indicated by the arrow of FIG. 17. When the transfer of the last toner image to the intermediate transfer drum 31 is started, the drive motor 3 starts to rotate, thereby disengaging the eccentric cam 2 from the bearing 56.

Thereupon, the heating roll 51, supported on the supporting base 53, is pressed against the intermediate transfer drum 31 by means of the urging force of the spring 57, as shown in FIG. 18, and the recording paper P is nipped between the drum 31 and the roll 51 as the last toner image is transferred to the surface of the drum 31. As a result, the toner images in the four colors, transferred in layers to the intermediate transfer drum 31, are heated under pressure and fixed to the recording paper P, whereupon the color print is formed.

The intermediate transfer drum 31 is rotatably supported substantially on the center of a supporting plate 33, one end of which is rockably mounted on the printer body 1*a* by means of a supporting shaft 33*a*. The drum 31 is pressed against the photosensitive drum 11 with a predetermined force of pressure by means of the urging force of a spring 34, one end of which is anchored to the body 1*a*, and the other end to the lower end of the supporting plate 33. The intermediate transfer drum 31 touches and leaves the photosensitive drum 11 as a release lever 35, which is in engagement with a stopper pin 33*b* on the lower portion of the supporting plate 33, is turned.

Figure 19:
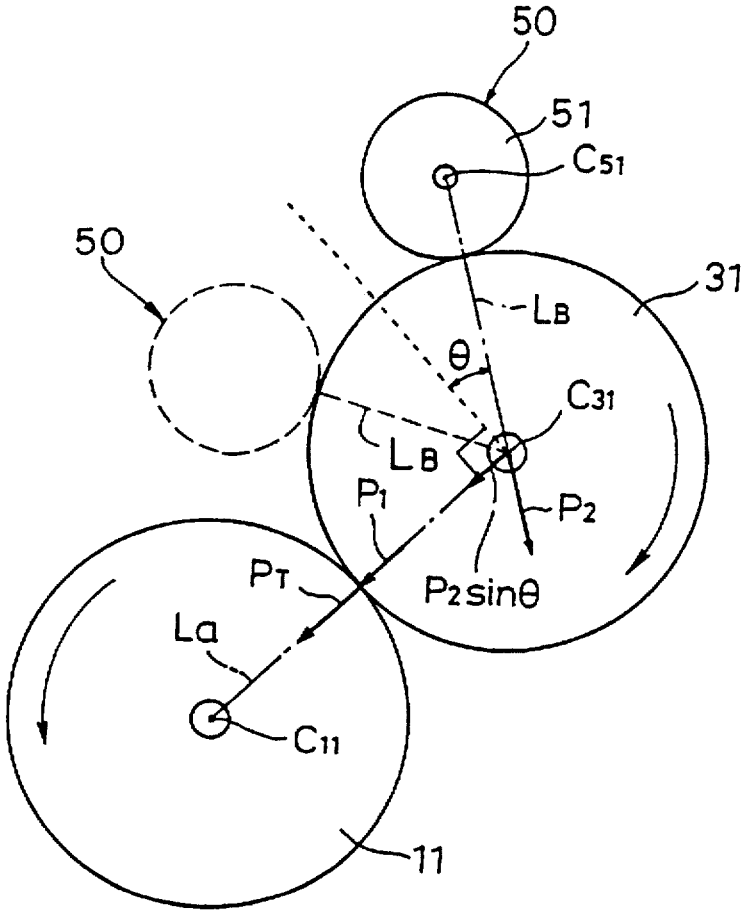
FIG. 19 is a schematic view showing a layout of the photosensitive drum, intermediate transfer drum, and a heating roll of the transfer-fixing means.

The heating roll 51 is arranged so that when it is pressed against the intermediate transfer drum 31, which is pressed against the photosensitive drum 11, a line $L_b$ which passes through rotating centers $C_{51}$ and $C_{31}$ of rotating shafts 51*a* and 31*a* of the heating roll 51 and the intermediate transfer drum 31, on the drawing plane of FIG. 19, is within an angular range from −30° to 30° with respect to the direction (on the drawing plane of FIG. 19) perpendicular to a line $L_a$ which passes through rotating centers $C_{11}$ and $C_{31}$ of rotating shafts 11*a* and 31*a* of the drums 11 and 31, on the same plane. This means that the line segment $L_B$ can form an angle (60°–90°; shown in phantom in FIG. 19) or an obtuse angle (90°–120°; shown with solid lines in FIG. 19) with respect to the line segment $L_a$.

If the angle formed between the line $L_b$ and the direction perpendicular to the line $L_a$ when the heating roll 51 is pressed against the intermediate transfer drum 31 is θ, as shown in FIG. 19, a force of pressure $P_T$ from the drum 31 and the roll 51 acting on the photosensitive drum 11 is given by $$P_T=P_1+P_2\cdot\sin\theta, \quad (1)$$

where the $P_1$ is the force of pressure contact between the drums 11 and 31, and $P_2$ is the force of pressure contact between the roll 51 and the drum 31.

Usually, in the electrophotographic printer 1, the force $P_1$ with which the intermediate transfer drum 31 is pressed against the photosensitive drum 11 is adjusted to 5 to 10 kg·f, and the force $P_2$ with which the heating roll 51 is pressed against the drum 31 is adjusted to 10 to 30 kg·f, in consideration of the transfer performance for transferring clear toner images from the photosensitive drum 11 to the intermediate transfer drum 31 without causing the images to be disfigured, as well as the transfer and fixing performance for the multicolor toner image transferred to and fixed on the recording paper P nipped between the intermediate transfer drum 31 and the heating roll 51.

The force of pressure $P_T$ has a minimum (≧0) when the forces $P_1$ and $P_2$ are the smallest. If $P_1$=5 kg·f and $P_2$=10 kg·f are given, therefore, the minimum value of the angle θ can be obtained. More specifically, we obtain $$P_T = 5 + 10\cdot\sin\theta \geqq 0,$$
$$\sin\theta \geqq -½,$$
$$\theta \geqq -30°.$$

To prevent the toner images from being disfigured, moreover, it is not advisable for the force of pressure $P_T$ to exceed two times of the force $P_1$ that the intermediate transfer drum 31 is pressed against the photosensitive drum 11. If $P_1$=5 kg·f and $P_2$=10 kg·f are given, therefore, the maximum value of the angle θ can be obtained. More specifically, we obtain $$P_T = 5 + 10\cdot\sin\theta \leqq 10,$$
$$\sin\theta \leqq ½,$$
$$\theta \leqq 30°.$$

As is evident from the above description, therefore, the heating roll 51 is arranged so that the angle θ formed between the line $L_b$ and the direction perpendicular to the line $L_a$ is within the range −30° to 30°.

Further preferably, the heating roll 51 is arranged so that the lines $L_a$ and $L_b$ are substantially perpendicular to each other, that is, the angle θ is substantially zero.

Put another way, the force relationships can be expressed as:

$$P_T=P_1+P_2\cdot\sin\theta$$

but it is not advisable for the force pressure $P_T$ to exceed two times the force $P_1$ (i.e., it is advisable for $P_T$ to be less than or equal to two times the force $P_1$):

$$2P_1 \geqq P_T$$

substituting for $P_T$ in the preceding equation, we obtain $$2P_1 \geqq P_1+P_2\cdot\sin\theta$$

or $$P_1 \geqq P_2\cdot\sin\theta.$$

Thus, when the heating roll 51 is pressed against the intermediate transfer drum 31, a component of the force $P_2$ acting in the direction along the line $L_b$ is reduced to zero with respect to the direction along the line $L_a$. Accordingly, the intermediate transfer drum 31 is not subjected to any stress such that the force of pressure contact of the drum 31, pressed against the photosensitive drum 11, with respect to the direction along the line $L_a$ is changed as the heating roll 51 is pressed against the drum 31. Accordingly, the intermediate transfer drum 31 is pressed against the photosensitive drum 11 with a constant force of pressure without exerting any influence upon the transfer of the toner images from the drum 11 to the drum 31.

It is to be understood that the electrophotographic printer 1 of the present invention may be used as a color copying machine, provided the print information is given in the form of reflected light from color original documents, and that the printer can produce single-color prints as well as color prints.

Although paper is used as the recording medium according to the embodiment described herein, moreover, the images may be also transferred to various other recording media, such as polyester film or other plastic films, metallic plates, cans, etc.

What is claimed is:

1. An electrophotographic printing apparatus for forming an image on a recording medium based on printing information, comprising;

a photosensitive drum;

latent image forming means, for forming a plurality of electrostatic latent images on said photosensitive drum based on the printing information;

developing means for developing said electrostatic latent images on said photosensitive drum using toners;

an intermediate transfer drum pressed against said photosensitive drum such that the toner images on said photosensitive drum are transferred to said intermediate transfer drum;

transport means for delivering the recording medium, to which the toner images are to be transferred, to and from said intermediate transfer drum; and a transfer roll for transferring the toner images from said intermediate transfer drum to the recording medium, said transfer roll being urged against said intermediate transfer drum with the recording medium being disposed therebetween;

fixing means for fixing the toner images on the recording medium;

wherein a force $P_1$ of pressure contact between said photosensitive drum and said intermediate transfer drum, and a force $P_2$ of pressure between said transfer roll and said intermediate transfer drum, and an angle θ formed between a line passing through the respective centers of rotation of said intermediate transfer drum and said transfer roll and a line perpendicular to the line passing through the respective centers of rotation of said photosensitive drum and said intermediate transfer drum meet the following relation, $$P_1 \geqq P_2 \sin \theta.$$

2. The electrophotographic printing apparatus of claim 1, wherein said transfer roll serves as said fixing means.

3. An electrophotographic printing apparatus for forming an image on a recording medium based on printing information, comprising:

a photosensitive drum;

latent image forming means, for forming an electrostatic latent image on said photosensitive drum based on the print information;

developing means for developing said electrostatic latent image on said photosensitive drum using a toner;

an intermediate transfer drum pressed against said photosensitive drum such that the toner image on said photosensitive drum is transferred to said intermediate transfer drum;

transport means for delivering the recording medium, to which the toner image is to be transferred, to and from said intermediate transfer drum;

a transfer roll for transferring the toner image from said intermediate transfer drum to the recording medium, said transfer roll being urged against said intermediate transfer drum with the recording medium being disposed therebetween; and fixing means for fixing the toner image on the recording medium;

wherein a force $P_1$ of pressure contact between said photosensitive drum and said intermediate drum, and a force $P_2$ of pressure contact between said transfer roll and said intermediate drum, and an angle θ formed between a line passing through the respective centers of rotation of said intermediate transfer drum and said transfer roll and a line perpendicular to the line passing through the respective centers of rotation of said photosensitive drum and said intermediate transfer drum, meet the equations, $$P_1 \geqq P_2 \sin \theta,$$

$$P_1 \leqq P_2.$$

4. The electrophotographic printing apparatus of claim 3, wherein said transfer roll serves as said fixing means.

5. The electrophotographic printing apparatus of claim 3, wherein said intermediate transfer drum receives a plurality of toner images formed in layers thereon.

6. An electrophotographic printing apparatus for forming an image on a recording medium based on printing information, comprising:

a photosensitive drum;

latent image forming means, for forming an electrostatic latent image on said photosensitive drum based on the printing information;

developing means for developing said electrostatic latent image on said photosensitive drum using a toner;

an intermediate transfer drum pressed against said photosensitive drum such that the toner image on said photosensitive drum is transferred to said intermediate transfer drum;

transport means for delivering the recording medium, to which the toner image is to be transferred, to and from said intermediate transfer drum;

a transfer roll for transferring the toner image from the intermediate transfer drum to the recording medium, said transfer roll being separated from said intermediate transfer drum during transfer of said toner image from said photosensitive drum to said intermediate transfer drum and pressing against said intermediate transfer drum with the recording medium therebetween after the transfer of said toner image from said photosensitive drum to said intermediate transfer drum by means of an eccentric cam, wherein, when said transfer roll presses against said intermediate transfer drum, a line intersecting the centers of rotation of said transfer roll and said intermediate transfer drum forms an acute angle between 60° and 90° relative to a line intersecting the centers of rotation of said intermediate transfer drum and said photosensitive drum; and fixing means for fixing the toner image on the recording medium.

7. The electrophotographic printing apparatus of claim 6, wherein said transfer roll serves as said fixing means.

8. The electrophotographic printing apparatus of claim 6, wherein said intermediate transfer drum receives a plurality of toner images formed in layers thereon.

9. A method for forming an image on a recording medium based on printing information, comprising the steps of:

(a) forming and developing a plurality of electrostatic latent images on a photosensitive drum based on the printing information; (b) transferring the images developed in said step (a) onto an intermediate transfer drum;

(c) delivering a recording medium to and from the intermediate transfer drum;

(d) transferring the toner images from the intermediate transfer drum to the recording medium using a transfer roll;

(e) providing a pressing force $P_1$ between the photosensitive drum and the intermediate transfer drum, and a pressing force $P_2$ urging the transfer roll against the intermediate transfer drum, and an angle θ between a first line passing through the respective canters of rotation of the intermediate transfer drum and the transfer roll and a second line perpendicular to the line passing through the respective centers of rotation of the photosensitive drum and the intermediate transfer drum, such that $P_1$, and $P_2$, and θ meet the relationship:

$P_1 \geqq P_2 \sin \theta$.

10. The method of claim 9, further comprising the step of:

(f) fixing the image on the recording medium, the image being a toner and the fixing being performed by the transfer roll.

11. A method for forming an image on a recording medium based on printing information, comprising the steps of:

(a) forming and developing an electrostatic latent image on a photosensitive drum based on the printing information;

(b) transferring the image developed in said step (a) onto an intermediate transfer drum;

(c) delivering a recording medium to and from the intermediate transfer drum;

(d) transferring the toner image from the intermediate transfer drum to the recording medium using a transfer roll;

(e) providing a pressing force $P_1$ between the photosensitive drum and the intermediate transfer drum, and a pressing force $P_2$ between the transfer roll and the intermediate drum, and an angle θ formed between a line passing through the respective centers of rotation of the intermediate transfer drum and the transfer roll and a line perpendicular to the line passing through the respective centers of rotation of the photosensitive drum and the intermediate transfer drum, the pressing forces $P_1$ and $P_2$ meeting the equation, $P_1 \geqq P_2 \sin \theta$.

$P_1 \leqq P_2$.

12. The method of claim 11, further comprising the step of:

(h) fixing the image on the recording medium, the image being a toner image and the fixing being performed by the transfer roll provided in said step (e).

13. The method of claim 11, wherein said step (b) includes the sub-step of:

transferring a plurality of images to the intermediate transfer drum, the images being toner images and being formed in layers on the intermediate transfer drum.

14. A method for forming an image on a recording medium based on printing information, comprising the steps of:

(a) forming and developing an electrostatic latent image on a photosensitive drum based on the printing information;

(b) transferring the image developed in said step (a) from the photosensitive drum to an intermediate transfer drum; and (c) transferring the toner image from the intermediate transfer drum to a recording medium using a transfer roll which is provided with an eccentric cam operatively associated therewith while the transfer roll is pressed against the intermediate transfer drum with the recording medium therebetween, the pressing being effectuated due to rotation of the eccentric cam, wherein said transfer roll is separated from the intermediate transfer drum during said step (b), and further wherein, when the transfer roll presses against the intermediate transfer drum, a line intersecting the centers of rotation of the transfer roll and the intermediate transfer drum forms an acute angle between 60° and 90° relative to a line intersecting the centers of rotation of the intermediate transfer drum and the photosensitive drum.

15. The method of claim 14, further comprising the step of:

(d) fixing the image on the recording medium, the image being a toner image and the fixing being performed by the transfer roll.

16. The method of claim 14, wherein said step (b) includes the sub-step of:

transferring a plurality of images to the intermediate transfer drum, the images being toner images and being formed in layers on the intermediate transfer drum.

17. An electrophotographic printing apparatus for forming an image on a recording medium based on printing information, comprising:

a photosensitive drum;

latent image forming means, for forming an electrostatic latent image on said photosensitive drum based on the printing information;

developing means for developing said electrostatic latent image on said photosensitive drum using a toner;

an intermediate transfer drum pressed against said photosensitive drum such that the toner image on said photosensitive drum is transferred to said intermediate transfer drum;

transport means for delivering the recording medium, to which the toner image is to be transferred, to and from said intermediate transfer drum;

a transfer roll for transferring the toner image from said intermediate transfer drum to the recording medium, said transfer roll being separated from said intermediate transfer drum during transfer of said toner image from said photosensitive drum to said intermediate transfer drum and pressing against said intermediate transfer drum with the recording medium therebetween after the transfer of said toner image from said photosensitive drum to said intermediate transfer drum by means of an eccentric cam; and fixing means for fixing the toner image on the recording medium;

wherein a force $P_1$ of pressure contact between said photosensitive drum and said intermediate transfer drum, and a force $P_2$ of pressure between said transfer roll and said intermediate transfer drum, and an angle θ formed between a line passing through the respective centers of rotation of said intermediate transfer drum and said transfer roll and a line perpendicular to the line passing through the respective centers of rotation of said photosensitive drum and said intermediate transfer drum meet the following relation, $P_1 \geqq P_2 \sin \theta$.

18. The electrophotographic printing apparatus of claim 17, wherein, when said transfer roll presses against said intermediate transfer drum, a line intersecting the centers of rotation of said transfer roll and said intermediate transfer drum forms an acute angle between 60° and 90° relative to a line intersecting the centers of rotation of said intermediate transfer drum and said photosensitive drum.

19. A method for forming an image on a recording medium based on printing information, comprising the steps of:

forming an electrostatic latent image on a photosensitive drum based on the printing information;

developing the electrostatic latent image on the photosensitive drum using a toner;

pressing an intermediate transfer drum against the photosensitive drum such that the toner image on the photosensitive drum is transferred to the intermediate transfer drum;

delivering a recording medium, to which the toner image is to be transferred, to and from the intermediate transfer drum;

transferring the toner image from the intermediate transfer drum to the recording medium using a transfer roll;

separating the transfer roll from the intermediate transfer drum during transfer of the toner image from the photosensitive drum to the intermediate transfer drum and pressing the transfer roll against the intermediate transfer drum with the recording medium therebetween after having transferred the toner image from the photosensitive drum to the intermediate transfer drum; and fixing the toner image on the recording medium, wherein a force $P_1$ of pressure contact between the photosensitive drum and the intermediate transfer drum, and a force $P_2$ of pressure between the transfer roll and the intermediate transfer drum, and an angle θ formed between a line passing through the respective centers of rotation of the intermediate transfer drum and the transfer roll and a line perpendicular to the line passing through the respective centers of rotation of the photosensitive drum and the intermediate transfer drum meet the following relation, $$P_1 \geqq P_2 \sin \theta.$$

20. The method of claim 19, wherein said steps of separating the transfer roll from the intermediate transfer drum and pressing the transfer roll against the intermediate transfer drum are executed by rotating an eccentric cam.

21. The method of claim 19, wherein, when the transfer roll presses against the intermediate transfer drum, a line intersecting the centers of rotation of the transfer roll and the intermediate transfer drum forms an acute angle between 60° and 90° relative to a line intersecting the centers of rotation of the intermediate transfer drum and the photosensitive drum.

22. An electrophotographic printing apparatus for forming an image on a recording medium based on printing information, comprising:

a photosensitive drum;

latent image forming means, for forming an electrostatic latent image on said photosensitive drum based on the print information;

developing means for developing said electrostatic latent image on said photosensitive drum using a toner;

an intermediate transfer drum pressed against said photosensitive drum such that the toner image on said photosensitive drum is transferred to said intermediate transfer drum;

transport means for delivering the recording medium, to which the toner image is to be transferred, to and from said intermediate transfer drum;

a transfer roll for transferring the toner image from said intermediate transfer drum to the recording medium, said transfer roll being separated from said intermediate transfer drum during transfer of said toner image from said photosensitive drum to said intermediate transfer drum and pressing against said intermediate transfer drum with the recording medium therebetween after the transfer of said toner image from said photosensitive drum to said intermediate transfer drum by means of an eccentric cam; and fixing means for fixing the toner image on the recording medium;

wherein a force $P_1$ of pressure contact between said photosensitive drum and said intermediate drum, and a force $P_2$ of pressure contact between said transfer roll and said intermediate drum, and an angle θ formed between a line passing through the respective centers of rotation of said intermediate transfer drum and said transfer roll and a line perpendicular to the line passing through the respective centers of rotation of said photosensitive drum and said intermediate transfer drum, meet the relationships, $$P_1 \geqq P_2 \sin \theta,$$

$$P_1 \leqq P_2.$$

23. An electrophotographic printing apparatus for forming an image on a recording medium based on printing information, comprising:

a photosensitive drum;

latent image forming means, for forming an electrostatic latent image on said photosensitive drum based on the print information;

developing means for developing said electrostatic latent image on said photosensitive drum using a toner;

an intermediate transfer drum pressed against said photosensitive drum such that the toner image on said photosensitive drum is transferred to said intermediate transfer drum;

transport means for delivering the recording medium, to which the toner image is to be transferred, to and from said intermediate transfer drum;

a transfer roll for transferring the toner image from said intermediate transfer drum to the recording medium, said transfer roll being separated from said intermediate transfer drum during transfer of said toner image from said photosensitive drum to said intermediate transfer drum and pressing against said intermediate transfer drum with the recording medium therebetween after the transfer of said toner image from said photosensitive drum to said intermediate transfer drum by means of an eccentric cam; and fixing means for fixing the toner image on the recording medium, wherein a force $P_1$ of pressure contact between said photosensitive drum and said intermediate drum, and a force $P_2$ of pressure contact between said transfer roll and said intermediate drum, meet the following relation, $$P_1 \leqq P_2$$

and further wherein when said transfer roll presses against said intermediate transfer drum, a line intersecting the centers of rotation of said transfer roll and said intermediate transfer drum forms an acute angle between 60° and 90° relative to a line intersecting the centers of rotation of said intermediate transfer drum and said photosensitive drum.

24. A method for forming an image on a recording medium based on printing information, comprising the steps of:

forming an electrostatic latent image on a photosensitive drum based on the print information;

developing the electrostatic latent image on the photosensitive drum using a toner;

pressing an intermediate transfer drum against the photosensitive drum such that the toner image on the photosensitive drum is transferred to the intermediate transfer drum;

delivering a recording medium, to which the toner image is to be transferred, to and from the intermediate transfer drum;

transferring the toner image from the intermediate transfer drum to the recording medium using a transfer roll;

separating the transfer roll from the intermediate transfer drum during transfer of the toner image from the photosensitive drum to the intermediate transfer drum and pressing the transfer roll against the intermediate transfer drum with the recording medium therebetween after having transferred the toner image from the photosensitive drum to the intermediate transfer drum; and fixing the toner image on the recording medium, wherein a force $P_1$ of pressure contact between the photosensitive drum and the intermediate drum, and a force $P_2$ of pressure contact between the transfer roll and the intermediate drum, and an angle θ formed between a line passing through the respective centers of rotation of the intermediate transfer drum and the transfer roll and a line perpendicular to the line passing through the respective centers of rotation of the photosensitive drum and the intermediate transfer drum, meet the relationships, $$P_1 \geqq P_2 \sin \theta,$$

$$P_1 \leqq P_2.$$

25. A method for forming an image on a recording medium based on printing information, comprising the steps of:

forming an electrostatic latent image on a photosensitive drum based on the print information;

developing the electrostatic latent image on the photosensitive drum using a toner;

pressing an intermediate transfer drum against the photosensitive drum such that the toner image on the photosensitive drum is transferred to the intermediate transfer drum;

delivering a recording medium, to which the toner image is to be transferred, to and from the intermediate transfer drum;

transferring the toner image from the intermediate transfer drum to the recording medium using a transfer roll;

separating the transfer roll from the intermediate transfer drum during transfer of the toner image from the photosensitive drum to the intermediate transfer drum and pressing the transfer roll against the intermediate transfer drum with the recording medium therebetween after having transferred the toner image from the photosensitive drum to the intermediate transfer drum; and fixing the toner image on the recording medium, wherein a force $P_1$ of pressure contact between the photosensitive drum and the intermediate drum, and a force $P_2$ of pressure contact between the transfer roll and the intermediate drum, meet the following relation, $$P_1 \leqq P_2$$

and further wherein, when the transfer roll presses against the intermediate transfer drum, a line intersecting the centers of rotation of the transfer roll and the intermediate transfer drum forms an acute angle between 60° and 90° relative to a line intersecting the centers of rotation of the intermediate transfer drum and the photosensitive drum.

26. The method of claim 24, wherein said steps of separating the transfer roll from the intermediate transfer drum and pressing the transfer roll against the intermediate transfer drum are executed by rotating an eccentric cam.

* * * * *